US011827043B2

(12) United States Patent
Kim et al.

(10) Patent No.: US 11,827,043 B2
(45) Date of Patent: Nov. 28, 2023

(54) KNOCKDOWN FOR COMPILING RECORDING MEDIA IN FINISHER

(71) Applicant: HEWLETT-PACKARD DEVELOPMENT COMPANY, L.P., Spring, TX (US)

(72) Inventors: Taehong Kim, Yongin-si (KR); Kevin Lo, Vancouver, WA (US); Matthew Raisanen, Battle Ground, WA (US); Stephen Thomas Rohman, Clackamas, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 224 days.

(21) Appl. No.: 17/049,834

(22) PCT Filed: May 11, 2018

(86) PCT No.: PCT/US2018/032282
§ 371 (c)(1),
(2) Date: Oct. 22, 2020

(87) PCT Pub. No.: WO2019/216913
PCT Pub. Date: Nov. 14, 2019

(65) Prior Publication Data

US 2021/0070079 A1 Mar. 11, 2021

(51) Int. Cl.

| | |
|---|---|
| ***B65H 29/38*** | (2006.01) |
| ***B41L 23/24*** | (2006.01) |
| ***B41F 23/08*** | (2006.01) |
| ***B65H 29/70*** | (2006.01) |

(52) U.S. Cl.
CPC ..... *B41L 23/24* (2013.01); *B41F 23/08* (2013.01); *B65H 29/38* (2013.01); *B65H 29/70* (2013.01)

(58) Field of Classification Search
CPC ..... B65H 29/40; B65H 9/10; B65H 9/103; B65H 9/106; B65H 31/26
See application file for complete search history.

(56) References Cited

U.S. PATENT DOCUMENTS

| | | | | |
|---|---|---|---|---|
| 6,666,445 | B2 | 12/2003 | Yamakawa et al. | |
| 7,866,647 | B2 | 1/2011 | Terao et al. | |
| 8,201,825 | B2 | 6/2012 | Kamiya et al. | |
| 9,016,681 | B2 * | 4/2015 | Mizubata ..... | G03G 15/6552 270/58.11 |
| 2002/0195768 | A1 | 12/2002 | Yamakawa et al. | |
| 2003/0214090 | A1 | 11/2003 | Kato et al. | |
| 2005/0133991 | A1 | 6/2005 | Ata et al. | |

(Continued)

FOREIGN PATENT DOCUMENTS

| | | |
|---|---|---|
| CN | 1480341 | 3/2004 |
| CN | 1524777 | 9/2004 |

(Continued)

*Primary Examiner* — Howard J Sanders
(74) *Attorney, Agent, or Firm* — Brooks, Cameron & Huebsch, PLLC

(57) ABSTRACT

A knockdown apparatus for a finisher includes a register tray, a paddle coupled to a rotatable shaft to compile a recording medium toward an end of the register tray, and a knockdown device, provided above the register tray, to rotate to apply a downward force to the recording medium while the recording medium is in the register tray to decrease a curl in the recording medium.

19 Claims, 19 Drawing Sheets

(56) References Cited

U.S. PATENT DOCUMENTS

| | | | | |
|---|---|---|---|---|
| 2011/0241275 | A1* | 10/2011 | Matsuo | B42C 1/125 271/226 |
| 2013/0249160 | A1* | 9/2013 | Wang | B41F 21/00 270/58.08 |
| 2014/0110312 | A1* | 4/2014 | Allen | B07C 3/02 414/798.2 |
| 2016/0060065 | A1 | 3/2016 | Tahara | |
| 2017/0320700 | A1 | 11/2017 | Proffitt et al. | |
| 2018/0312361 | A1* | 11/2018 | Iwamoto | B65H 33/08 |

FOREIGN PATENT DOCUMENTS

| | | | |
|---|---|---|---|
| CN | 1778656 | | 5/2006 |
| CN | 102001545 | | 4/2011 |
| CN | 102343725 | | 2/2012 |
| CN | 103358724 | | 10/2013 |
| EP | 2450749 | A2 | 5/2012 |
| JP | 6227755 | | 8/1994 |
| JP | 2002-293471 | | 10/2002 |
| JP | 2003073014 | | 3/2003 |
| JP | 2008001485 | | 1/2008 |
| JP | 2013193870 | | 9/2013 |
| KR | 10-1805593 | | 11/2017 |

* cited by examiner

KNOCKDOWN FOR COMPILING RECORDING MEDIA IN FINISHER

CROSS REFERENCE TO RELATED APPLICATIONS

This application is filed under 35 U.S.C. § 371 as a National Stage of PCT International Application No. PCT/US2018/032282, filed on May 11, 2018, in the U.S. Patent and Trademark Office, the disclosure of which is incorporated by reference herein in its entirety.

BACKGROUND

A finisher refers to an apparatus for processing a recording medium, such as paper, supplied from an image forming apparatus. The finisher can be connected to the image forming apparatus to receive the recording medium during a job, and is in communication with the image forming apparatus. For example, the finisher may perform a stapling operation, an alignment operation, and/or a folding operation with respect to the recording medium supplied from the image forming apparatus.

An image forming apparatus refers to an apparatus that forms images on a recording medium according to inputted signals. Examples of an image forming apparatus include a printer, a copy machine, a scanner, a facsimile, and a multi-function peripheral device that combines and implements various functions of the printer, copy machine, scanner, and/or facsimile. Examples of a printer include an inkjet printer or a laser printer.

DETAILED DESCRIPTION

Figure 1:
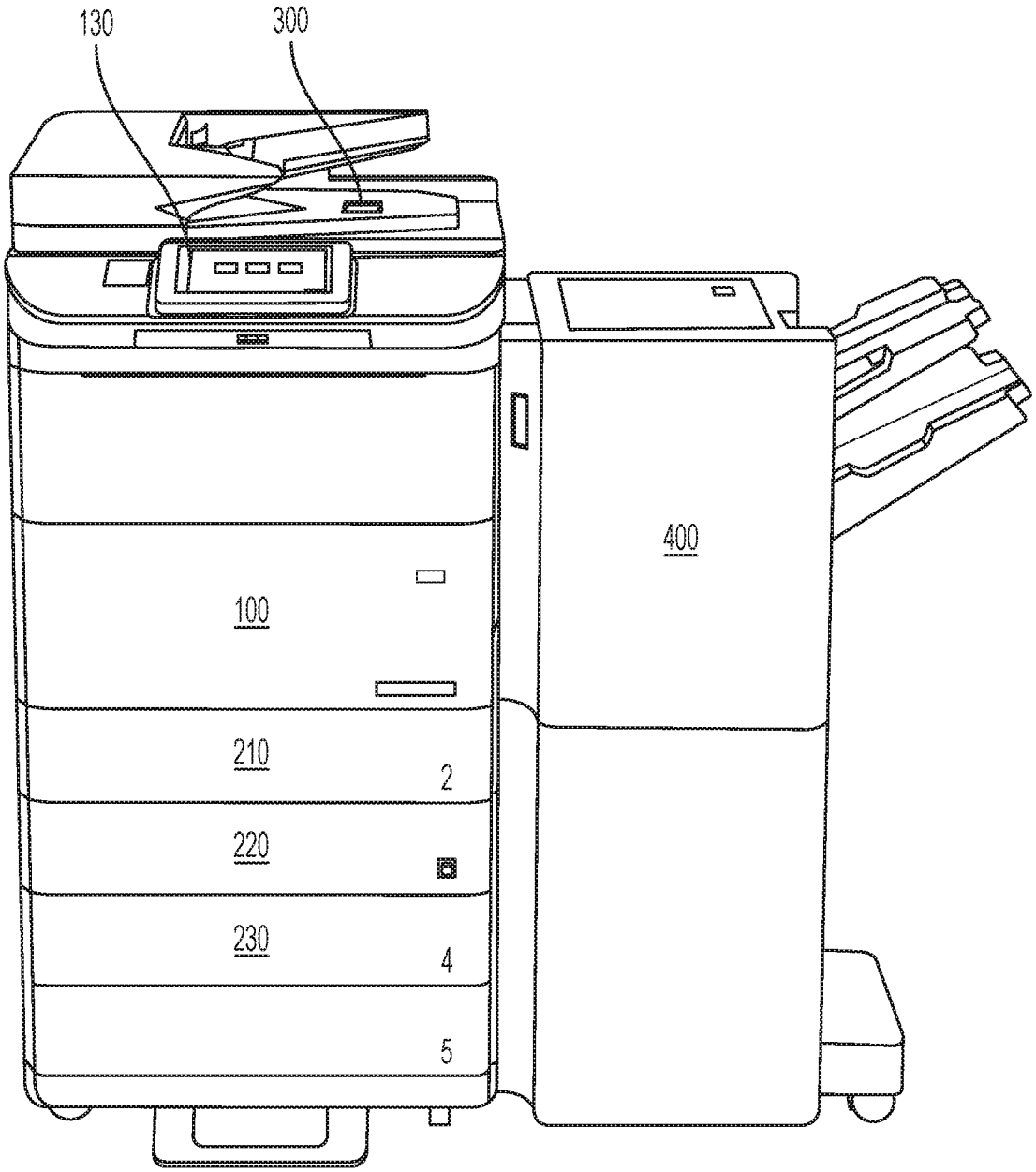
FIG. 1 is a schematic structural diagram of an image forming apparatus and finisher according to an example.

Before a recording medium is compiled and a finishing operation is performed on the recording medium by a finisher, an image forming apparatus may perform a conditioning process on the recording medium. For example, the conditioning process may remove water, smooth the recording medium, or a combination thereof. The conditioning process may be more difficult when there is a significant amount of ink placed on the recording medium. To remove the water from the recording medium, a temperature of a heated pressure roller within the image forming apparatus may be raised, however the increase temperature can result in a curled or "smiling" recording medium.

When the curled "smiling" recording medium is transported to a compiler area of the finisher, the curled "smiling" recording medium can fill the compiler area. The compiler area may include paddles to pull a recording medium toward an end portion of a registration tray for a finishing operation to be performed on the recording medium. However, because the recording medium is curled, this may prevent the paddles from pulling the recording medium toward the end portion of the registration tray. Thus, a finishing operation may have poor compiling of recording media, the finishing operation may be poorly performed on the recording media, and a size of a stack of recording media for which the finishing operation is to be performed on may be limited.

According to various examples of the disclosure, a finisher includes a knockdown apparatus which knocks down a recording medium during the compiling process of the recording medium so as to flatten the recording medium and eliminate or decrease the curl. Because the curl can be decreased or eliminated, a job quality of compiled media stacks may be improved, increased temperatures may be utilized in the image forming apparatus to remove moisture from a recording medium, and a stack capacity may be increased.

Various examples of the disclosure will now be described with reference to the accompanying drawings, wherein like reference characters denote like elements. Examples to be explained in the following may be modified and implemented in various different forms.

When it is stated in the disclosure that one element is "connected to" or "coupled to" another element, the expression encompasses not only an example of a direct connection or direct coupling, but also a connection with another element interposed therebetween. Further, when it is stated herein that one element "includes" another element, unless otherwise stated explicitly, it means that yet another element may be further included rather than being excluded.

FIG. 1 is a schematic structural diagram of an image forming apparatus and finisher 400 according to an example. Referring to FIG. 1, the image forming apparatus includes a printer 100 and a scanner 300 coupled to a finisher 400.

The printer 100 prints an image on a sheet-type medium, which may also be referred to as a recording medium, provided from a paper feeder. The paper feeder may be, for example, a main cassette feeder 210 installed under the printer 100, or secondary cassette feeders 220 and 230 installed under the main cassette feeder 210. Although not illustrated, the paper feeder may further include a multi-purpose tray (MPT), a high capacity feeder installed at a side of the printer 100, or a combination thereof.

The printer 100 may also include a control panel 130 to receive an input from a user to control the image forming apparatus, for example to perform a function of the image forming apparatus. The control panel 130 may include a keyboard, a button, a display, or combinations thereof for the user to operate the image forming apparatus. The display may be a touchscreen to receive the input from the user.

The printer 100 may print an image on a recording medium by using various printing methods such as an electrophotography method, an inkjet method, a thermal transfer method, and a thermal sublimation method. For example, the image forming apparatus may print a color image on the recording medium by using an inkjet method. The printer 100 may be a S path-type of printer or a C path-type of printer, for example.

The scanner 300 reads an image recorded on a document. The scanner 300 may have any of various structures such as a flatbed mechanism where a document is at a fixed position and an image is read while a reading member is moved, a document feeding mechanism where a reading member is at a fixed position and a document is fed, and a combination structure thereof.

The finisher 400 may include a sheet folding device (not illustrated) for folding, one or more times, the recording medium discharged from the printer 100. The finisher 400 may further include an alignment device (not illustrated) for aligning the recording medium discharged from the printer 100. The alignment device may have a structure for stapling the recording medium at an end portion thereof or punching a hole in an end portion of the recording medium. The finisher 400 may further include a stapler for stapling the paper at a center portion thereof. Other example processes or functions the finisher 400 may perform include hole punching, binding, embossing, gluing, coating, varnishing, foil stamping, texturing, lamination, cutting, creasing, stacking, binding, splicing, rewinding, or combinations thereof.

Figure 2:
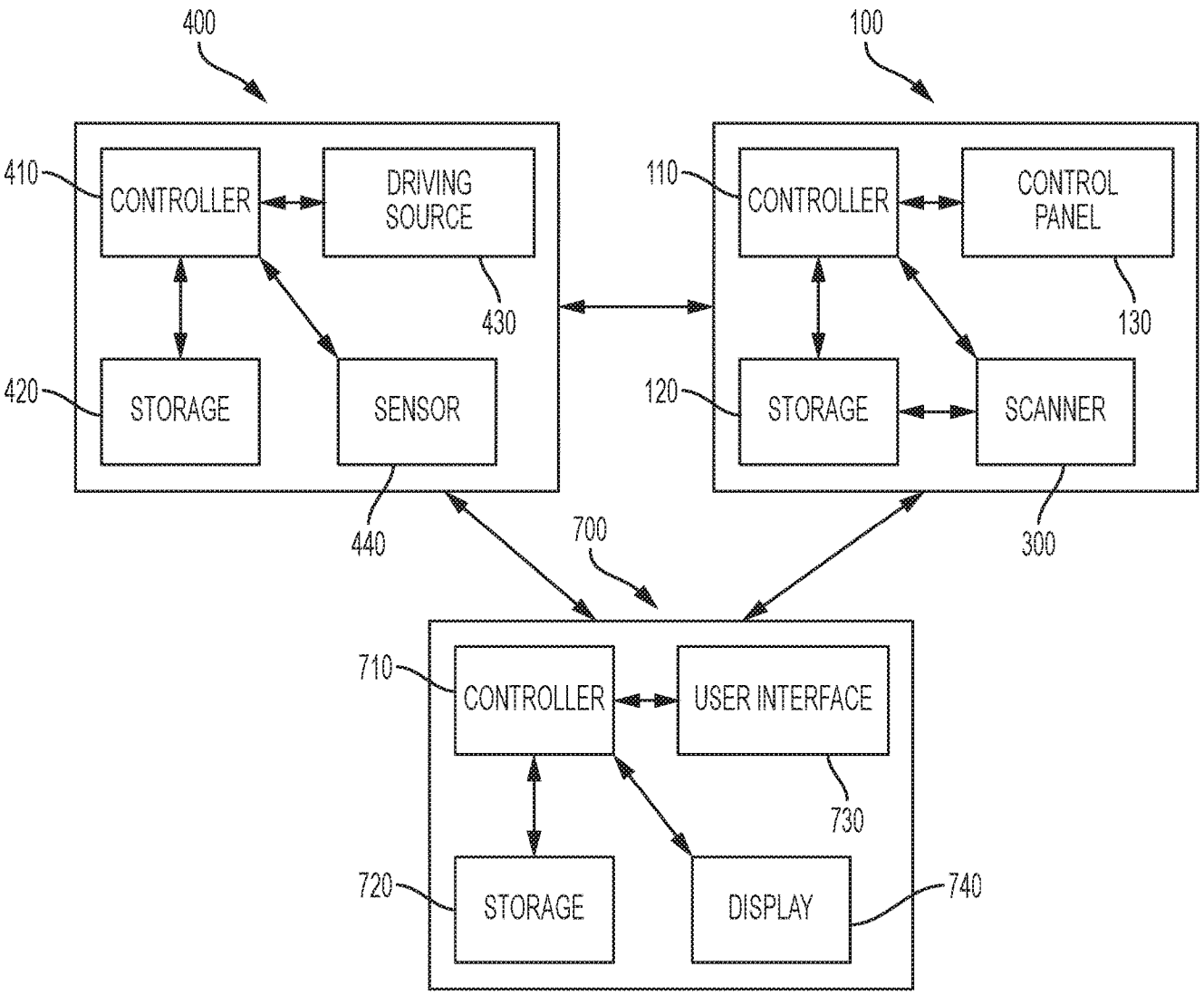
FIG. 2 is a block diagram of the printer and the finisher according to an example.

FIG. 2 is a block diagram of the printer 100, the finisher 400, and an external device 700, according to an example. In FIG. 2, the printer 100 includes controller 110 and machine readable storage 120, the finisher 400 includes controller 410 and machine readable storage 420, and the external device includes controller 710 and machine readable storage 720. The finisher 400 also includes a driving source 430 and a sensor 440 which will be discussed in more detail below. The driving source 430 may include a motor, solenoid, other electromechanical devices, or combinations thereof. The sensor 440 may include a position sensor that senses a position of a recording medium on a path in the finisher, a weight sensor, a proximity sensor, a light sensor, or combinations thereof.

The finisher 400 may include a controller 410 and machine readable storage 420. The controller 410 may execute instructions stored in the machine readable storage 420. The printer 100 may also include a controller 110 and machine readable storage 120. The finisher 400, the printer 100, and the external device 700 may be connected with one another in a wired and/or wireless manner such that the finisher 400, printer 100, and external device 700 can communicate with one another to exchange information, including job information regarding an image forming job performed or to be performed by the image forming apparatus including the printer 100 and scanner 300, a finishing job performed or to be performed by the finisher 400, or combinations thereof.

The controllers 110, 410, 710 may include, for example, a processor, an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof.

The machine readable storages 120, 420, 720 may be any electronic, magnetic, optical, or other physical storage device that stores executable instructions. For example, the machine readable storages 120, 420, 720 may include a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof.

The external device 700 may include a personal computer, a laptop, a tablet, a smartphone, a server, or combinations thereof. The external device 700 may be used to control the finisher 400, the printer 100, or combinations thereof. For example, the external device 700 may receive an input from a user regarding a job or function of the finisher 400, the printer 100, or combinations thereof. The external device 700 may include a user interface 730 to receive the input and a display 740 to display information regarding the finisher 400 and the printer 100. The user interface 730 may include, for example, a keyboard, a mouse, a joystick, a button, a switch, an electronic pen or stylus, a gesture recognition sensor, an input sound device or voice recognition sensor such as a microphone, an output sound device such as a speaker, a track ball, a remote control, a touchscreen, or combinations thereof. The external device 700 may also include a display 740.

Figure 3A:
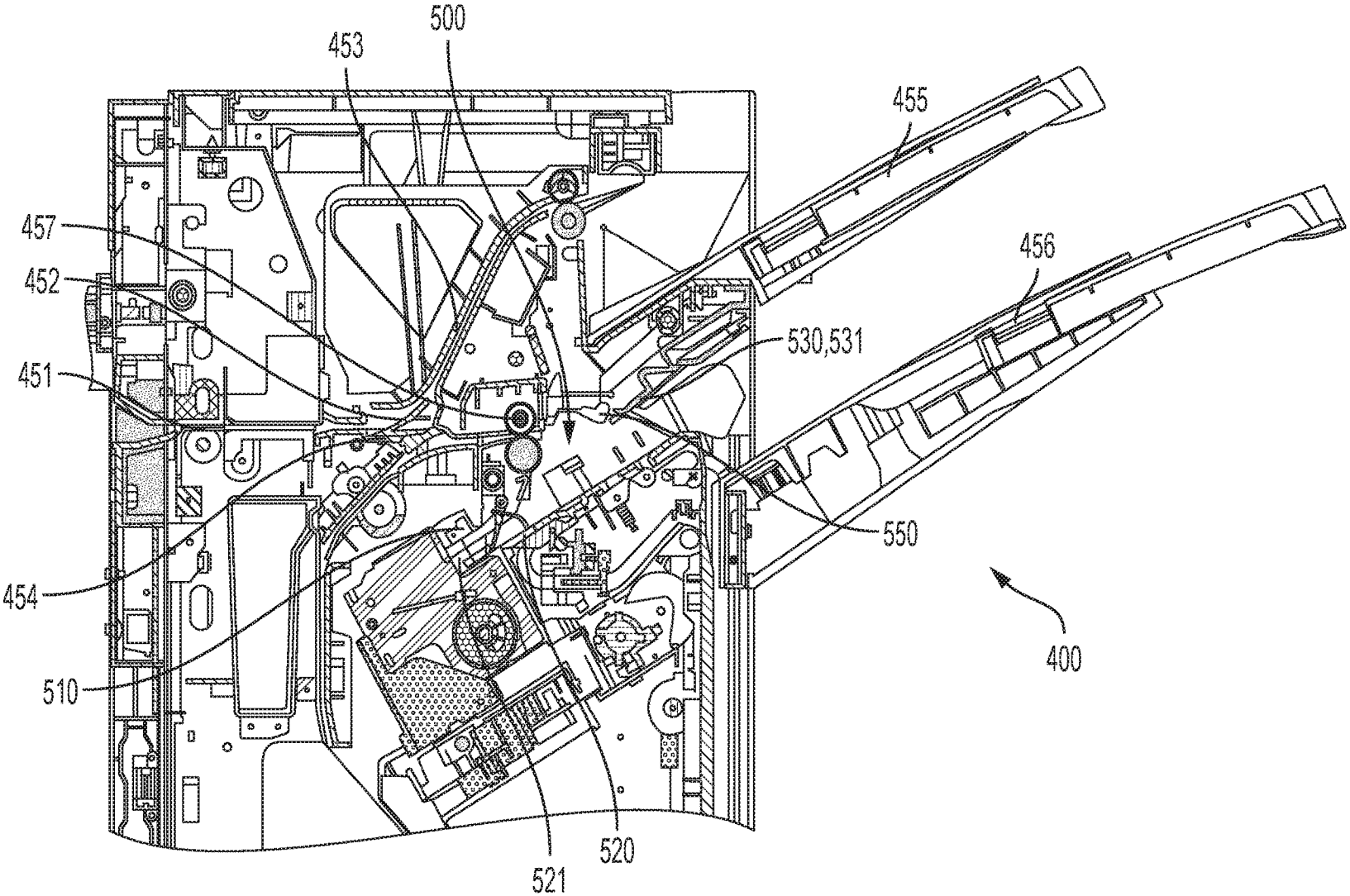
FIGS. 3A-3B are schematic cross-sectional views of the finisher according to an example.
Figure 3B:
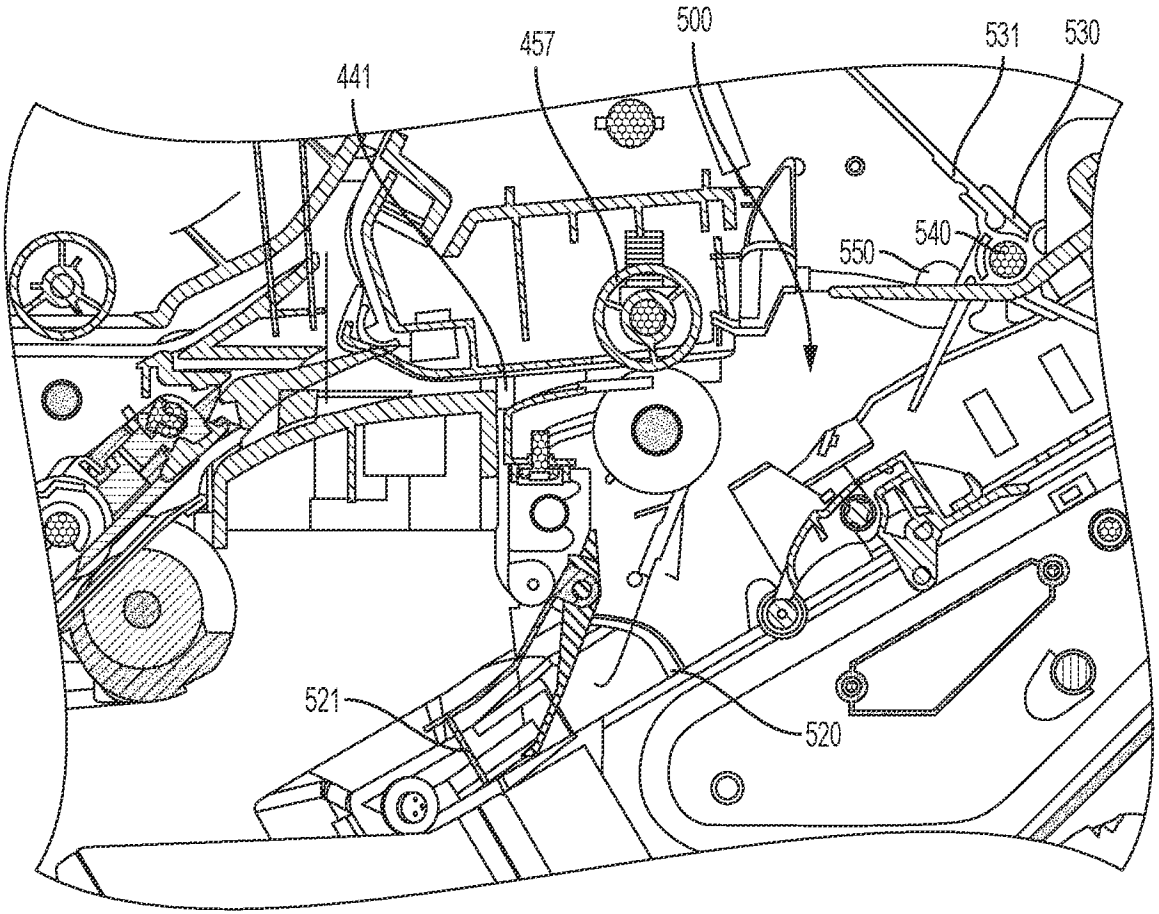

FIGS. 3A-3B are schematic cross-sectional views of the finisher according to an example.

Example paths traveled on by the recording medium in the finisher 400 will now be described. The recording medium is received by the finisher 400 from the printer 100 at an input port 451. Depending on the design of the finisher 400 and the processes to be performed on the recording medium, there may be numerous paths that the recording medium may be transported on before being output to an output bin. For example, as illustrated in FIG. 3A, a diverter 452 may divert the recording medium to an upper path 453 or a lower path 454 for the recording medium to be output to an upper output bin 455 or a lower output bin 456. Various rollers and other devices may contact and handle a recording medium within the finisher 400. The rollers and other devices may be driven by various motors, solenoids, and other electromechanical devices, which can be controlled via the controller 410 of the finisher 400, the controller 110 of the printer 100, or a controller located elsewhere, or by a combination thereof.

As illustrated in FIG. 3A, the finisher 400 includes an upper output bin 455 and a lower output bin 456. The upper output bin 455 may be utilized for simple jobs in which a finishing process or collated stacking is not performed. For example, a recording medium may be transported along the upper path 453 to be output to the upper output bin 455 when a stapling operation is not performed on the recording medium. The lower output bin 456 may be utilized for jobs for which a stacking or stapling operation is performed. For example, a recording medium may be transported along the lower path to be output to the lower output bin 456 when a stapling operation is performed on the recording medium. The lower output bin 456 may be movable. For example, the lower output bin 456 may be lowered or raised. The lower output bin 456 may be lowered or raised depending on a number of recording media that are held by the lower output bin 456.

When a finishing process is to be performed with respect to a recording medium and the recording medium is transported along the lower path 454, the recording medium may be transported to a section of the finisher 400 referred to as a compiler 500. The compiler 500 may include a stapler 510 to staple the recording medium to another recording medium or to recording media before the stapled media is ejected or discharged from the compiler 500 and output to the lower output bin 456. The compiler 500 may also include a register tray 520, a pusher bar 550 and a tamper 560 (see FIG. 5), to be described in more detail below.

Figure 4A:
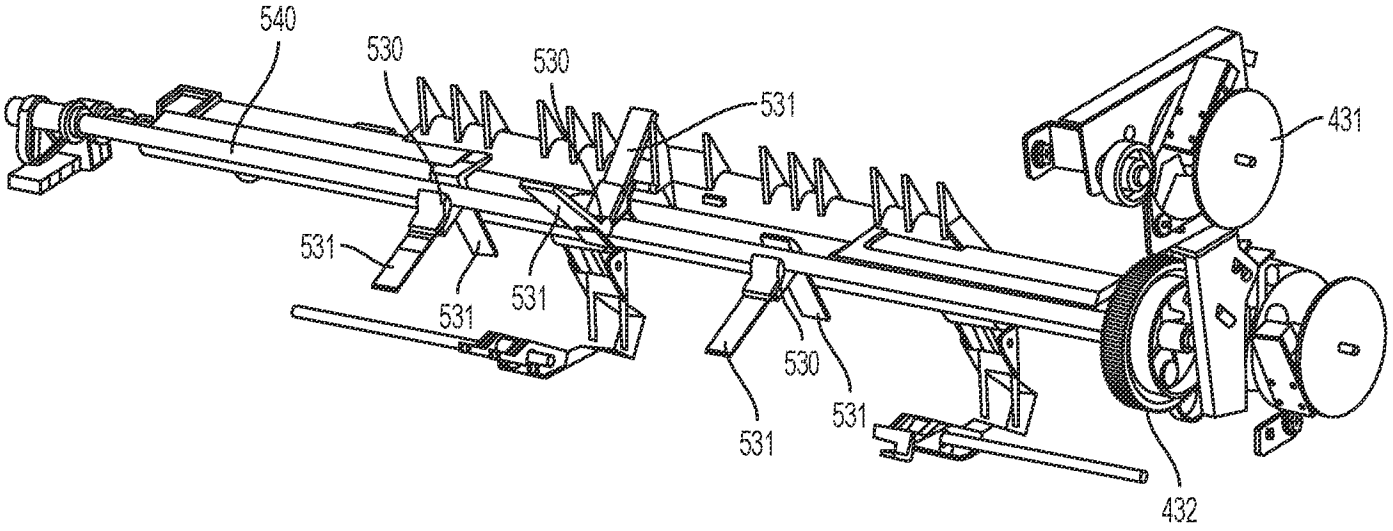
FIG. 4A is a perspective view illustrating a plurality of paddle units coupled to a rotatable shaft according to an example.
Figure 4B:
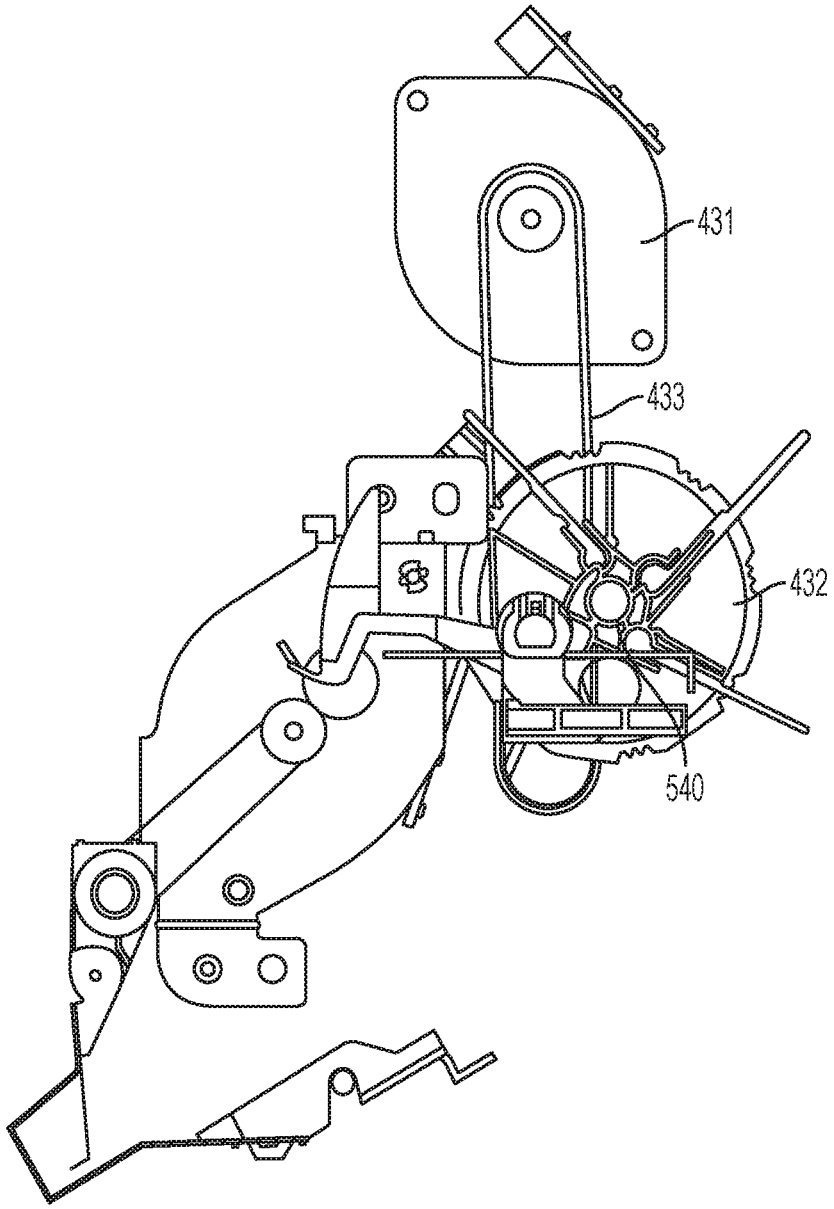
FIG. 4B is a side view illustrating a driving source coupled to a rotatable shaft according to an example.

FIG. 4A is a perspective view illustrating a plurality of paddle units 530 coupled to a rotatable shaft 540 according to an example. FIG. 4B is a side view illustrating a driving source coupled to a rotatable shaft according to an example. The compiler 500 may include the paddle units 530 coupled to the rotatable shaft 540 as shown in FIG. 4A.

As illustrated in FIG. 4A each of the paddle units 530 includes a plurality of paddles 531. The plurality of paddle units 530 coupled to the rotatable shaft 540 may be located at spaced apart intervals along the rotatable shaft 540 in an axial direction of the rotatable shaft 540. The plurality of paddles 531 can be at spaced apart intervals, circumferentially about the respective paddle unit 530. Each of the paddles 531 extends in a radial direction outward from the paddle unit 530 and rotatable shaft 540. For example, there may be three paddle units 530 coupled to the rotatable shaft 540. Each of the paddle units 530 may include two paddles 531 at spaced apart intervals, circumferentially about the respective paddle unit 530. However, the disclosure is not so limited and there may be more than three paddle units 530 or less than three paddle units 530. Furthermore, there may be more than two paddles 531 on a respective paddle unit 530, or less than two paddles 531. For example, there could be a single paddle unit 530 coupled to the rotatable shaft 540 where the paddle unit 530 has a single paddle 531. The paddle 531 may be made of polyurethane. However, the paddle 531 may be made of another material. For example, the material of the paddle 531 may be selected based on frictional characteristics. For example, the material of the paddle 531 may be selected so that the recording medium may be pulled back to the end portion 521 of the register tray 520 efficiently. As shown in FIG. 4A, the paddle 531 may have a substantially rectangular shape.

The driving source 430 may include a motor, a solenoid, another electromechanical device, or combinations thereof. For example, as illustrated in FIG. 4B the driving source 430 may include a motor 431, a gear 432 coupled to the rotatable shaft 540, and a driving belt 433 coupling the motor 431 to the gear 432 to drive rotation of the rotatable shaft 540 according to a signal output from the controller 410. The rotatable shaft 540 may be rotated in a first direction and a second direction by the driving source 430. The first direction may be referred to as a "forward" direction and the second direction may be referred to as a "reverse" direction. The first direction may be a clockwise direction and the second direction a counterclockwise direction. Or the first direction may be a counterclockwise direction and the second direction a clockwise direction. The paddles 531 rotate together with the rotation of the rotatable shaft 540. Because the paddles 531 are coupled to the rotatable shaft 540, when the rotatable shaft 540 is rotated in the forward direction, the paddles 531 rotate together with the rotatable shaft 540 in the forward direction. When the paddles 531 are rotated in the forward direction during a compiling operation, the paddles 531 compile a recording medium in a direction toward an end portion 521 of the register tray 520 so that the recording media, which are stacked on top of one another, are aligned at the end portion 521 of the register tray 520 and can be stapled together by the stapler 510 in a defined manner. As a number of recording media accommodated in the register tray 520 increases, a height of the compiled stack of recording media also increases.

An example path along which the recording medium travels to the compiler 500 will now be described with respect to FIG. 1. For example, with reference to FIGS. 3A and 3B the recording medium may pass through a pair of exit rollers 457 and drop down to the register tray 520. An exit roller sensor 441 located at or near the exit rollers 457 can detect a position of the recording medium. The exit roller sensor 441 may also be referred to as position sensor 441. The sensor 440 can include the exit roller sensor 441. For example, the exit roller sensor 441 can detect when the recording medium arrives at the exit rollers 457, passes through the exit rollers 457 to the register tray 520, or a combination thereof. The exit roller sensor 441 may send a signal to the controller 410 indicating a position of the recording medium. For example, the signal may indicate the recording medium has arrived at the exit rollers 457 or has passed through the exit rollers 457 to the register tray 520. In this way the controller 410 can determine how many recording media are accommodated in the register tray 520 during a finishing operation. For example, the controller 410 can include a counter to count or index the number of recording media that have arrived at the exit rollers 457 or passed through the exit rollers 457 during the finishing operation.

As the recording medium drops down from the exit rollers 457 to the register tray 520 the pusher bar 550 may rotate to push downward against a trailing edge of the recording medium to assist the recording medium in dropping down to the register tray 520. When the recording medium is located on the register tray 520 the rotatable shaft 540 and paddles 531 may rotate in the forward direction. For example, during the compiling of the recording medium, the controller 410 may transmit a signal to the driving source 430 to control the driving source 430 to rotate the rotatable shaft 540 in the forward direction. Also, when the recording medium is located on the register tray 520 the tamper 560 may be moved in an inward direction toward opposite sides of the recording media to align the stacked recording media in a widthwise direction of the recording medium. The tamper 560 may be moved in the inward direction toward opposite sides of the recording media a plurality of times to align the stacked recording media in the widthwise direction.

Figure 5:
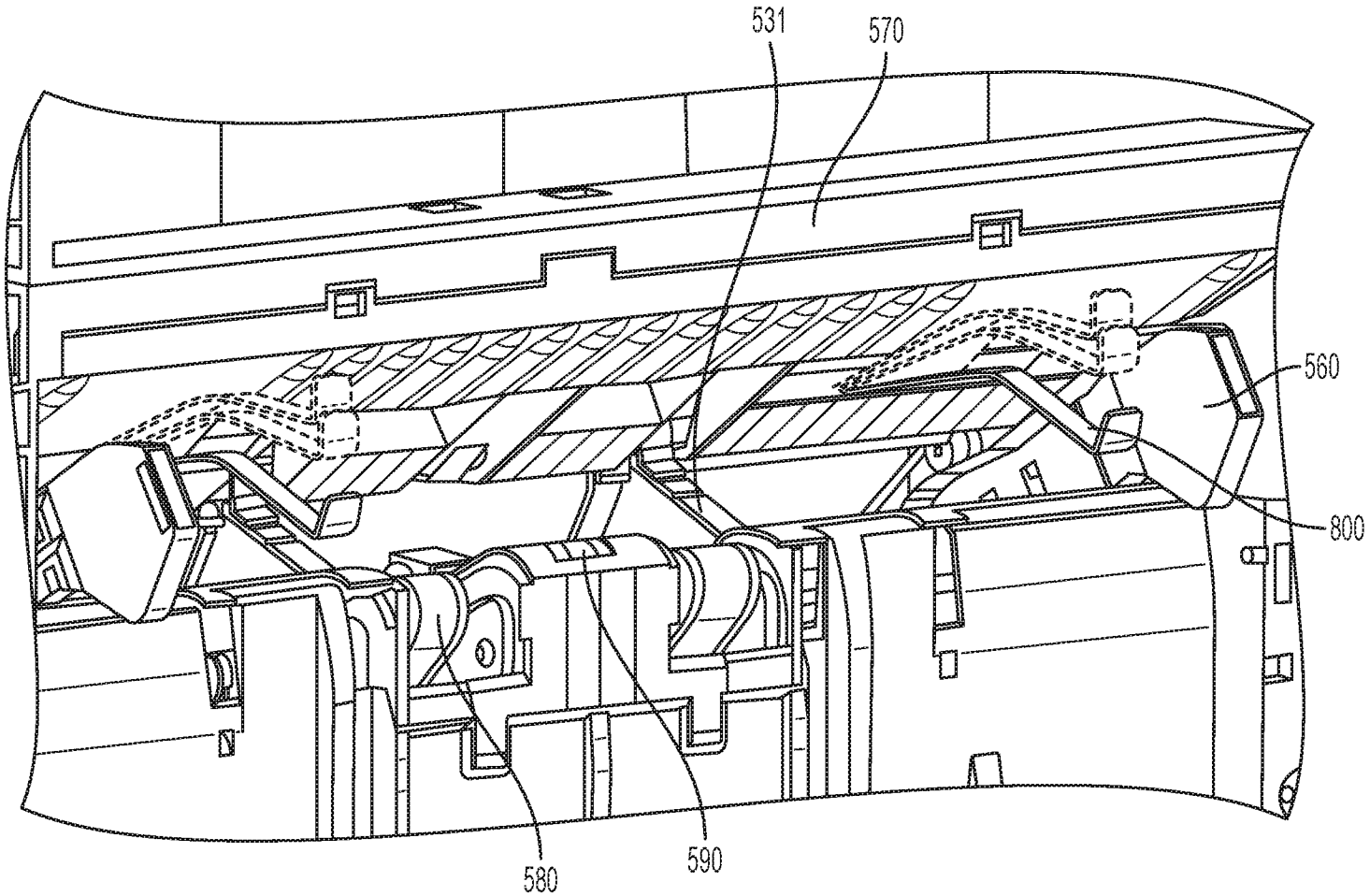
FIG. 5 is a perspective view of a knockdown device, according to an example.
Figure 6:
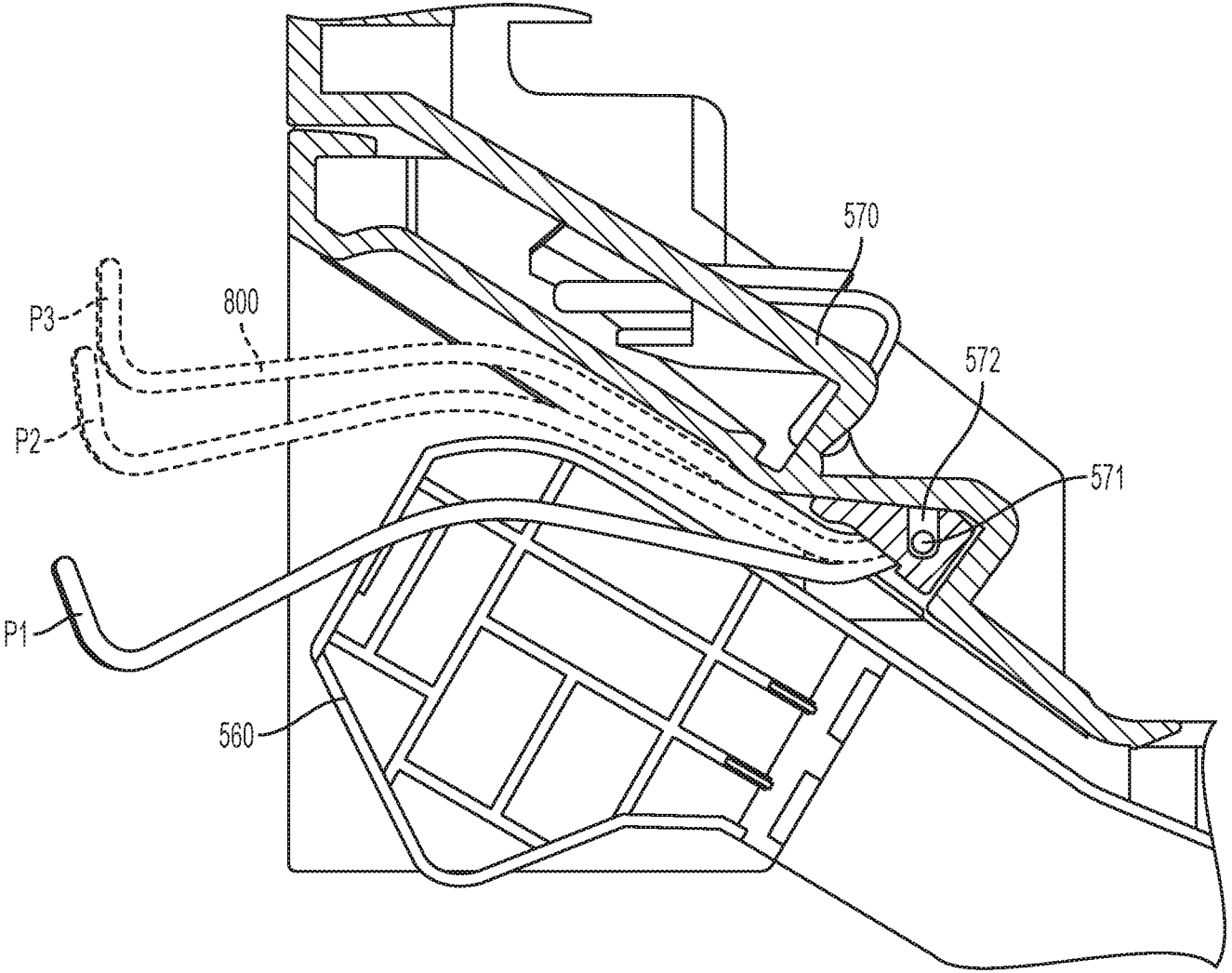
FIG. 6 is a side view of a knockdown device, according to an example.

FIG. 5 is a perspective view of a knockdown device 800 coupled to an upper paper guide 570 of the compiler 500 according to an example. FIG. 6 is a side view of the knockdown device 800 coupled to the upper paper guide 570 of the compiler 500 according to an example. The compiler 500 includes a knockdown device 800 to knock down a recording medium during the compiling process of the recording medium so as to flatten the recording medium and eliminate or decrease a curl in the recording medium. As shown in FIG. 6, a body of the knockdown device 800 includes one end coupled to a pin 571 installed in the upper paper guide 570 such that the knockdown device 800 is rotatable about the pin 571 similar to a hinge. The pin 571 can be provided in a groove or slot 572 of the upper paper guide 570. As another example, the pin 571 may be provided on an end of the knockdown device 800 as a rotatable knockdown shaft of the knockdown device 800, and inserted into the groove or slot 572 of the upper paper guide 570. The upper paper guide 570 may be mounted inside a main body of the finisher. For example, the upper paper guide 570 may be mounted or coupled to a frame of the finisher. Two knockdown devices 800 can be coupled to the upper paper guide 570, for example. For example, the knockdown devices 800 can be positioned to knockdown the recording medium on opposite sides of the recording medium in the widthwise direction. For example, each knockdown device 800 can extend outward from the upper paper guide 570 at a location between a tamper 560 and a paddle 531 coupled to the rotatable shaft 540. The knockdown device 800 may be located at a position spaced apart from the tamper 560 such that the tamper 560 does not strike the knockdown device 800 when the tamper 560 moves inward to align the sides of the recording media stacked in the registration tray during compiling of the recording media. In another example to be further described below, the tamper 560 may contact the knockdown device. For example, when the tamper 560 moves inward the tamper 560 may slide under the knockdown device 800 and cause the knockdown device 800 to rotate upward. When the tamper 560 moves outward the knockdown device 800 then rotates back downward by the force of gravity.

As shown in FIG. 6, the knockdown device 800 is rotatable about the pin 571 to rotate between a resting or lower position P1 and an upper position P3. An intermediate position P2 is also shown in FIG. 6. In the resting position P1, the knockdown device 800 may be spaced apart from the register tray 520 in a vertical direction. An angle of the knockdown device 800 in the resting position P1, for example relative to a plane perpendicular to a rotation axis of the pin 571, or a height of above the registration tray 520, may be set according to a force to be applied to the recording medium in the downward direction and the pulling force of the paddles 531 which pull the recording medium toward the end portion of the register tray 520. If the register tray 520 contains recording media, depending on a height of the stack of recording media, in the resting position P1 the knockdown device 800 may rest on an upper surface of a top recording medium of the stack of recording media, or the knockdown device 800 may be spaced apart from the upper surface of the top recording medium of the stack of recording media.

When the knockdown device 800 is in the resting position P1 and a recording medium is transported from the exit rollers 457 to the register tray 520 in the compiler 500, the recording medium may be partially ejected in an outward direction toward the lower output bin 456, before being pulled back in toward the end portion 521 of the register tray 520 by the paddles 531 of the compiler 500. When the recording medium is partially ejected in the outward direction toward the lower output bin 456, a leading edge of the recording medium contacts inner sides of the knockdown devices 800 and causes the knockdown devices 800 to rotate upward. An amount of rotation of the knockdown devices 800 in the upward direction may be depend on various factors including the force applied to the knockdown devices 800 by the recording medium according to the speed of travel of the recording medium, a weight of the recording medium, a weight of the knockdown device 800, or combinations thereof, for example. After the knockdown devices 800 swing upward, the knockdown devices 800 then rotate downward by a force of gravity to apply a downward force on an upper surface of the recording medium. The knockdown devices 800 may apply the downward force on the upper surface of the recording medium as the recording medium is being pulled back toward the end portion of the register tray 520. Therefore, the knockdown device 800 can reduce a curl in the recording medium when in the resting position and also by applying a downward force when the knockdown device 800 rotates downward and contacts the upper surface of the recording medium.

The knockdown device can have various shapes. For example, the knockdown device may have a substantially rectangular shape as shown by the knockdown device 800' illustrated in FIG. 8. As another example, as illustrated in FIGS. 7A-7B, the knockdown device 800 may have a first portion 800A that extends at one end outward from the upper paper guide 570, a second portion 800B that has one end bent downward from the other end of the first portion 800A, and a third portion 800C that has one end bent upward from the other end of the second portion 800B.

A width of the knockdown device in the widthwise direction may also be varied. For example, a wider width of the knockdown device 800' compared to the knockdown device 800 in the widthwise direction may allow the knockdown device 800 to contact a greater area of the recording medium and to contact different types of recording media with narrower widths.

A weight of the knockdown device along a direction perpendicular to the widthwise direction and an axial direction of the rotatable shaft may also be varied. For example, a first end of the knockdown device, opposite of a second end of the knockdown device coupled to the upper paper guide 570, may have a greater weight compared to the second end of the knockdown device coupled to the upper paper guide. The greater weight of the first end of the knockdown device may allow a greater downward force to be applied to the recording medium.

Figure 7A:
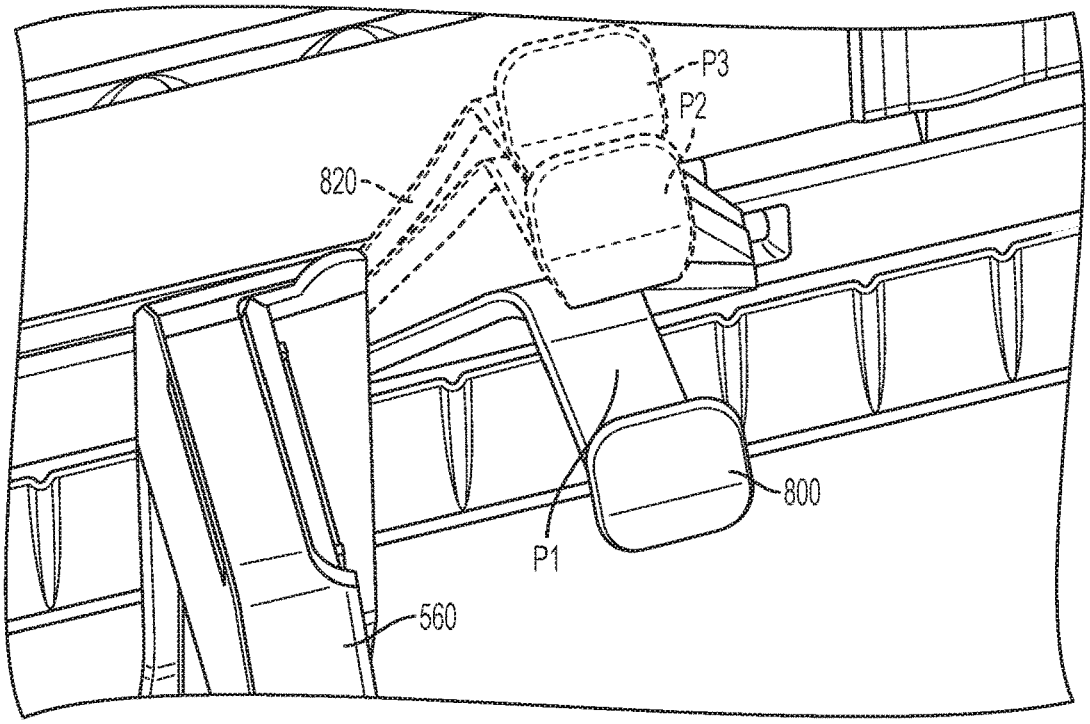
FIGS. 7A-7B are enlarged views of a tamper and knockdown device according to an example.
Figure 7B:
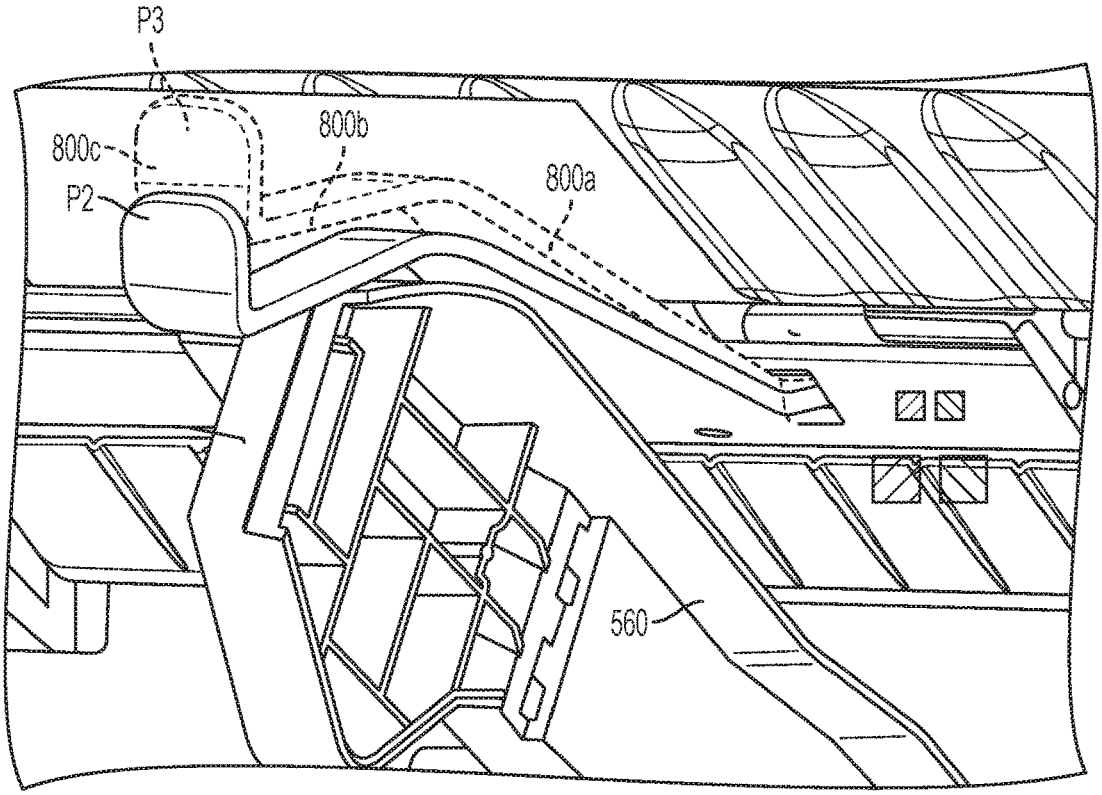

FIGS. 7A-7B are enlarged views of the tamper 560 and knockdown device 800 according to an example. As mentioned above, in an example the tamper 560 may contact the knockdown device. For example, as shown in FIGS. 7A and 7B, when the tamper 560 moves inward the tamper 560 may engage ramps 820 on an outer side of the knockdown device 800 to lift the knockdown device 800 out of the way. The ramps 820 may extend from the second end of the knockdown device 800 in an inward direction such that the knockdown device 800 is tapered, with the second end of the knockdown device 800 being wider than the first end of the knockdown device 800 in the widthwise direction. The tamper 560 slides under the knockdown device 800 and causes the knockdown device 800 to rotate upward. When the tamper 560 moves outward the knockdown device 800 then rotates back downward. Because the knockdown device 800 can be lifted by the tamper 560, the knockdown device 800 may be located further outward and closer to the tamper 560.

Figure 8:
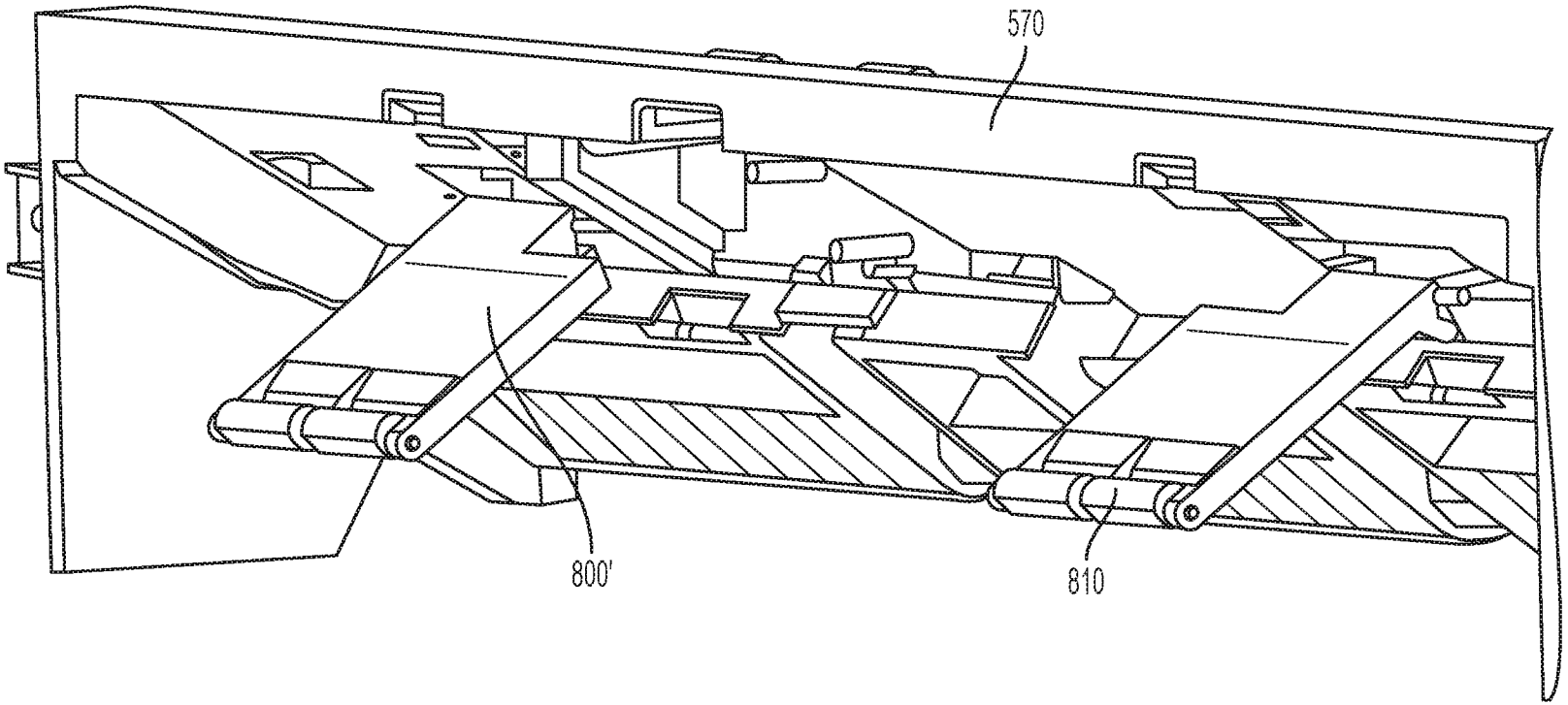
FIG. 8 is perspective view of a knockdown device, according to an example.

FIG. 8 is perspective view of knockdown device 800' according to an example. As shown in FIG. 8, the first end of the knockdown device 800', opposite of the second end of the knockdown device 800' coupled to the upper paper guide 570, may include roller wheels 810. The roller wheels 810 can reduce a friction force between the knockdown device 800' and the upper surface of the recording medium. The reduced friction force may allow the paddles 571 to more easily pull the recording medium toward the end portion 521 of the register tray 520. As shown in FIG. 8, the first end of the knockdown device 800' has two roller wheels 810. However, a single roller wheel or more than two roller wheels may be provided at the first end of the knockdown device. Although not shown, the knockdown device 800 illustrated in FIGS. 5 to 7B may also include roller wheels 810 at the first end of the knockdown device 800.

Accordingly, the rotatable knockdown devices 800 and 800' shown in FIGS. 5 through 8 can knock down the recording medium during the compiling process of the recording medium so as to flatten the recording medium and eliminate or decrease a curl in the recording medium.

Figure 9:
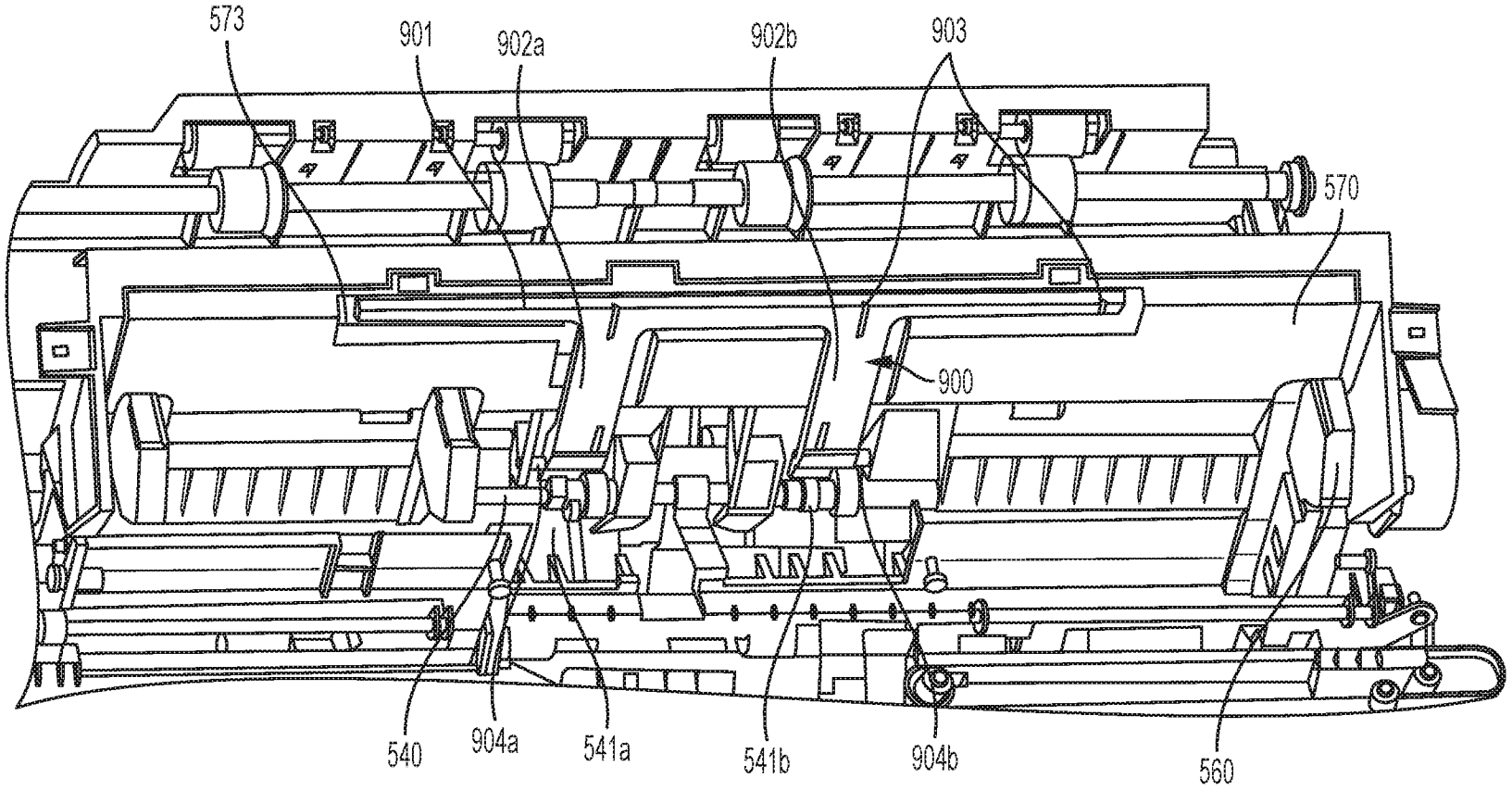
FIG. 9 is a perspective view of a knockdown device, according to an example.
Figure 10:
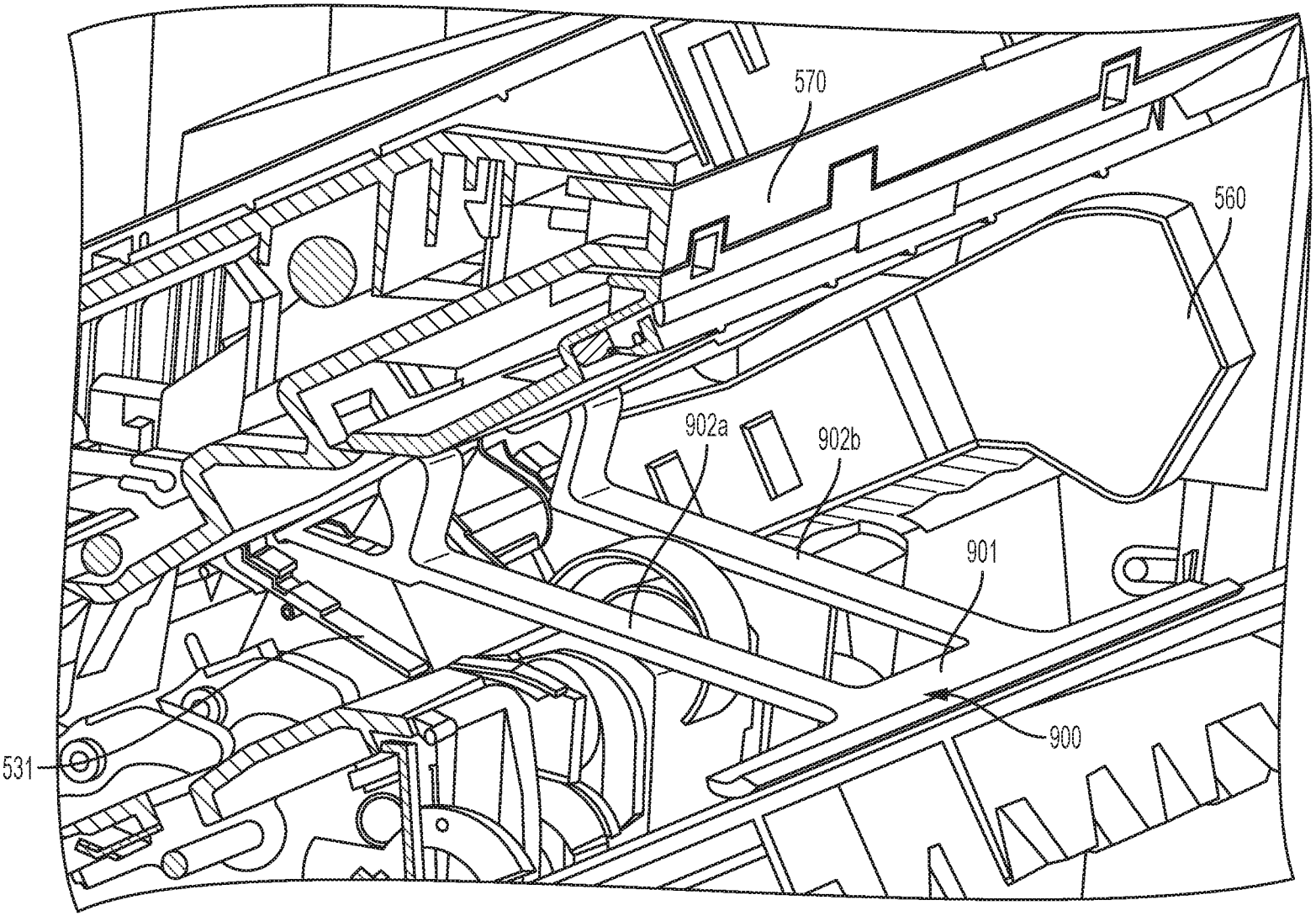
FIG. 10 is a side view of a knockdown device, according to an example.
Figure 11:
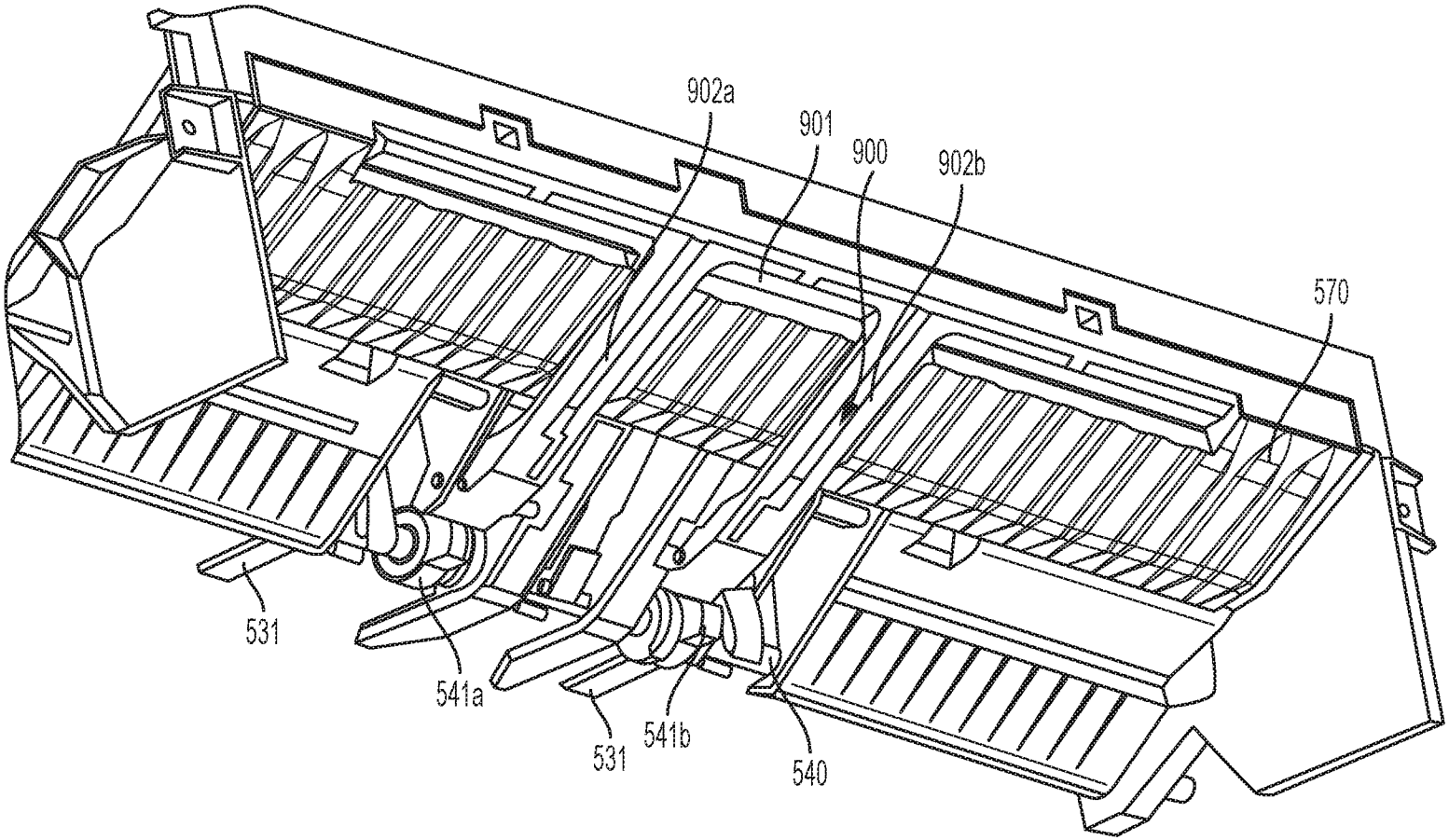
FIG. 11 is a perspective view of a knockdown device, according to an example.

FIG. 9 is a perspective view of a knockdown device 900 in an upper position and coupled to an upper paper guide 570 of the compiler 500, according to an example. FIG. 10 is a side view of the knockdown device 900 in a lower position, according to an example. FIG. 11 is another view of the knockdown device 900 coupled to the upper paper guide 570 of the compiler 500 according to an example. The knockdown 900 includes a body 901 that is elongated in a direction perpendicular to a rotation axis of the rotatable shaft 540. A length of the body 901 may be chosen in consideration of a range of widths of recording mediums that may be processed by the finisher 400 balanced with avoiding contacting with the tamper 560 during the compiling operation, for example. In FIG. 9, one end of each of the arms 902*a*, 902*b* extends from the body and the other end of each of the arms 902*a*, 902*b* is coupled to the upper paper guide 570.

The knockdown device 900 is mounted to the upper paper guide 570. For example, each arm 902*a*, 902*b* is coupled to the upper paper guide 570 by a rotatable knockdown shaft 904*a*, 904*b* that is formed as a protrusion or pin which protrudes from an outer side of each of the arms 902*a*, 902*b*. The rotatable knockdown shafts 904*a*, 904*b* are inserted into a groove or pinhole 572 that is formed in a portion of the upper paper guide 570. The knockdown device 900 is rotatable about the rotatable knockdown shafts 904*a*, 904*b*, such that a rotation axis of the knockdown device 900 is parallel to and offset from a rotation axis of the rotatable shaft 540.

The upper paper guide 570 may include a cutout or recess 573 formed therein to accommodate the arms 902*a*, 902*b* and body 901 of the knockdown device 900 when the knockdown device 900 is in an upper position. The ability to store the knockdown device 900 in the recess 573 while the knockdown device 900 is not being utilized allows the knockdown device 900 to avoid contact with a recording medium being compiled as well as recording media stacked in the register tray 520. Also, a sound-dampening material may be provided in the recess 573 so that when the knockdown device 900 returns to the upper position, a noise may be reduced or minimized. A sound-dampening material can also be provided on an upper side of the knockdown device 900. The sound-dampening material may include an acoustic foam, for example.

Figure 14:
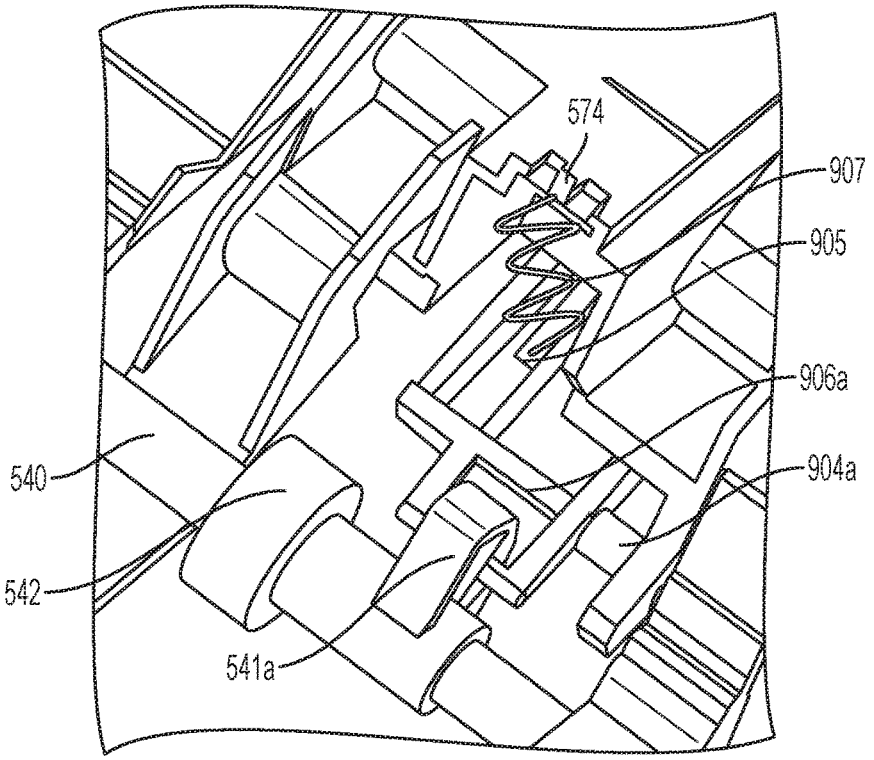

To retain the knockdown device 900 in the upper position, an elastic member 907 may be coupled between a hook 574 formed in the upper paper guide 570 and a receptacle 905 provided in an end portion or tab 906*a* of arm 902*a* of the knockdown device 900, as shown in FIG. 14 according to an example. The arm 902*b* of the knockdown device 900 also includes an end portion or tab 906*b*. The elastic member 907 may be an extension spring for example.

A plurality of ribs 903 may be formed on a lower surface of the knockdown device 900. The ribs 903 protrude from the lower surface of the knockdown device 900 such that when the knockdown device 900 contacts the recording medium a surface area of the knockdown device 900 that contacts the recording medium is less than a surface area of the knockdown device 900 that contacts the recording medium when no ribs are provided. Therefore, a noise level caused by the knockdown device 900 striking the recording medium can be reduced. The knockdown device 900 may be made of plastic, for example.

The knockdown device 900 may include surfaces which are chamfered, curbed, or angled in such a way to reduce a noise associated with rotating the knockdown in an upward and downward motion. For example, the body 901, the arms 902*a*, 902*b*, the ribs 903, or a combination thereof, may have curved surfaces.

Figure 12:
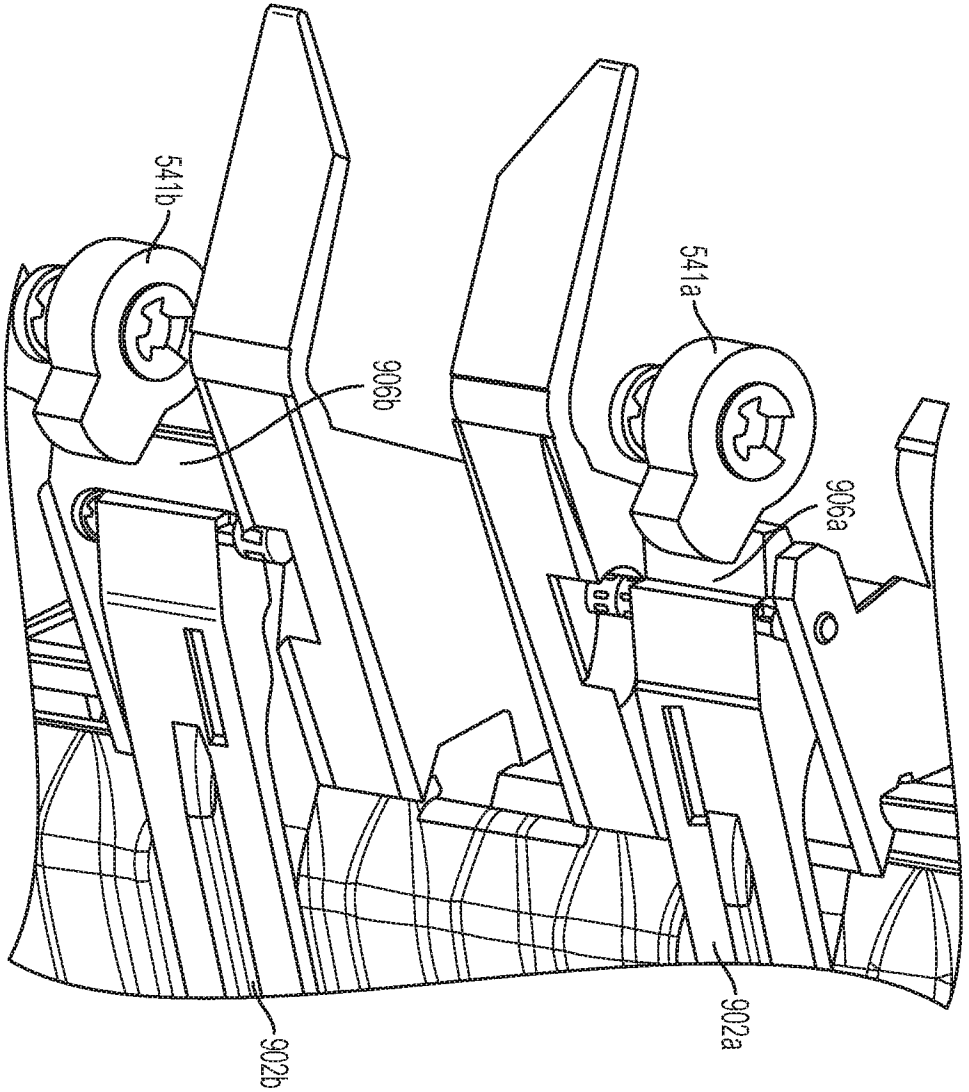
FIG. 12 is a view illustrating cams in contact with a knockdown device, according to an example.
Figure 13:
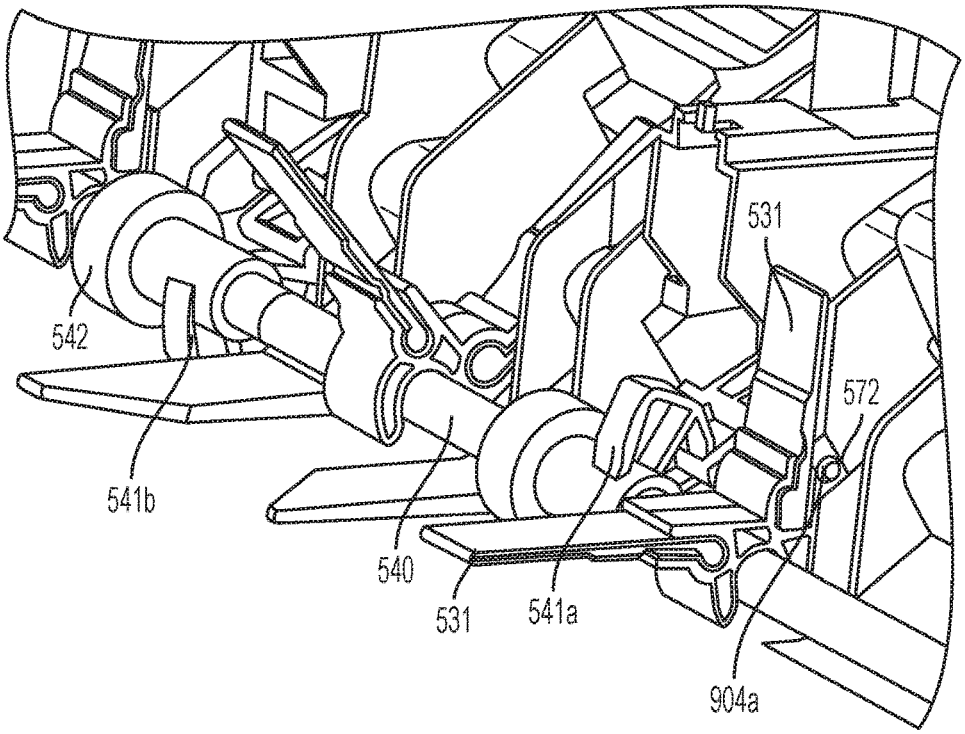
FIGS. 13 and 14 are perspective views illustrating a rotatable shaft and cams from a rear side of an upper paper guide, according to an example.

FIG. 12 is a view illustrating cams 541*a*, 541*b* in contact with tabs 906*a*, 906*b* of the knockdown device 900, according to an example. The knockdown device 900 can be rotated by rotation of the cams 541*a*, 541*b* which are coupled to the rotatable shaft 540. The interaction between the cams 541*a*, 541*b* and knockdown device 900 may be similar to a see-saw mechanism. As illustrated in FIG. 12, an upper side of the cams 541*a*, 541*b* may contact a lower side of tab 906*a*, 906*b* of the knockdown device 900. When the cams 541*a*, 541*b* are rotated in a counter-clockwise direction, the tabs 906*a*, 906*b* are moved upward and the opposite side of the knockdown device 900 which includes the body 901 and arms 902*a*, 902*b* is moved downward. As illustrated in FIGS. 13 and 14, the cams 541*a*, 541*b* may be interlocked with tabs 906*a*, 906*b* of the knockdown device 900, according to an example. However, as illustrated in FIG. 12, the cams 541*a*, 541*b* may be located near or abut the tabs 906*a*, 906*b* of the knockdown device 900 without being interlocked, according to an example.

FIGS. 13 and 14 are views illustrating the rotatable shaft 540 and cams 541*a*, 541*b* from a rear side of the upper paper guide 570. As shown in FIG. 14, a one-way clutch 542 may be coupled to the rotatable shaft 540 to control rotation of a corresponding cam such that the cams rotate in one direction but do not rotate in the other direction. For example, a one-way clutch 542 may be provided for each of the cams 541*a*, 541*b*. A one-way clutch 542 may be incorporated for each cam 541*a*, 541*b* on the rotatable shaft 540 such that when the rotatable shaft 540 and paddles 531 rotate in the forward direction to pull the recording medium back toward the end portion 521 of the register tray 520, the cams 541*a*, 541*b* do not rotate, and when the rotatable shaft 540 and paddles 531 rotate in the reverse direction, the cams 541*a*, 541*b* are rotated via the corresponding one-way clutch 542 to actuate the tabs 906*a*, 906*b* of the knockdown device 900 and cause the knockdown device 900 to rotate downward and contact the recording medium to apply a downward force to the recording medium. According to another example, the one-way clutch 542 may instead be a friction clutch.

An operation of the knockdown device 900 will now be described according to an example. When the recording medium drops down from the exit rollers 457 to the register tray 520 the pusher bar 550 may rotate to push downward against a trailing edge of the recording medium to assist the recording medium in dropping down to the register tray 520. When the recording medium is located on the register tray 520 the rotatable shaft 540 and paddles 531 may rotate in the forward direction. The rotatable shaft 540 and paddles 531 may rotate in the forward direction once or a plurality of times. For example, during the compiling of the recording medium, the controller 410 may transmit a signal to the driving source 430 to control the driving source 430 to rotate the rotatable shaft 540 in the forward direction a predetermined number of times. The driving source 430 may be a motor, for example. The signal or command indicates to the driving source 430 the number of times the rotatable shaft 540 is to be rotated by the driving source 430 in the forward direction during a compiling operation with respect to the recording medium. A number of rotations of the rotatable shaft 540 in the forward direction for compiling a recording medium can vary. For example, the controller 410 can determine the number of rotations of the rotatable shaft 540 in the forward direction based on information regarding the recording medium, information regarding the finishing operation, or combinations thereof.

Information regarding the recording medium and finishing operation may be obtained from the printer 100, the finisher 400 itself, from another source, or combinations thereof. As an example, when a job is received at the printer 100, the printer 100 may communicate with the finisher 400 by transmitting a signal including job information to the finisher 400 that identifies, or is indicative of, various characteristics pertaining to the job. For example, the job information may include a number of recording media to be compiled, a type of recording medium, a thickness of the recording medium, an ink content on the recording medium, or combinations thereof. The job information may be in the form of a code. The controller 410 of the finisher 400 can interpret the job information received from the printer 100, for example by interpreting the code, to obtain the job information. The controller 410 can store the job information in the machine readable storage 420.

According to an example, because the one-way clutch 542 prevents rotation of the cams 541*a*, 541*b* during forward rotation of the rotatable shaft 540, the cams 541*a*, 541*b* do not rotate, and the knockdown device 900 is not rotated, when the rotatable shaft 540 is rotated in the forward direction.

After completion of the forward rotation of the rotatable shaft 540 and paddles 531, the rotatable shaft 540 may be rotated in a reverse direction. For example, the controller 410 may transmit a signal to the driving source 430 to control the driving source 430 to rotate the rotatable shaft 540 in the reverse direction a predetermined number of times. According to an example, because the one-way clutch 542 permits rotation of the cams 541*a*, 541*b* during reverse rotation of the rotatable shaft 540, the cams 541*a*, 541*b* rotate and the knockdown device 900 is rotated downward to contact the recording medium. For example, the knockdown device 900 may contact the leading edge or front portion of the recording medium. The cams 541*a*, 541*b* are rotated a same number of times the rotatable shaft 540 is rotated in the reverse direction. The knockdown device 900 performs the knockdown action a same number of times the rotatable shaft 540 is rotated in the reverse direction. The number of reverse rotations of the rotatable shaft 540 may be once or a plurality of times. The number of reverse rotations of the rotatable shaft 540 may be less than the number of times the rotatable shaft 540 and paddles 531 are rotated in the forward direction for paddling the recording medium. As another example, the controller 410 may determine no reverse rotation of the rotatable shaft 540 is to be performed. For example, the controller 410 may determine, based on a type of recording medium for example, that the recording medium is unlikely to have a curl and therefore the knockdown is not performed by the knockdown device 900.

Actuation of the knockdown device 900 is based on the rotation of the rotatable shaft 540 to drive the motion of the knockdown device 900, for example. The cams 541*a*, 541*b* are coupled to the rotatable shaft 540 through a one-way clutch or friction clutch so as to control the timing of the knockdown actuation. The knockdown device 900 can be activated such that rotation of the rotatable shaft 540 in the reverse direction causes the knockdown device 900 to lower once per cycle. According to this operation, actuation of the knockdown device 900 is performed independent of a number of forward paddles performed to compile media. As another example, rotation of the knockdown device 900 may be based on the rotation of the rotatable knockdown shafts 904*a*, 904*b*, which may be combined as a single shaft, to drive the motion of the knockdown device 900. That is, a driving source, other than a driving source used to drive rotatable shaft 540, may be provided to drive rotation of the rotatable knockdown shaft and the knockdown device 900.

The knockdown device 900 is rotated to contact the recording medium and may be immediately rotated back upwards to the upper position to be stored in the recess 573 of the upper paper guide 570. The knockdown device 900 may be lowered for a duration long enough to contact the recording medium and eliminate or reduce the curl in the recording medium, while also not delaying completion of the compiling and finishing operations unnecessarily. Also, because the knockdown actuation occurs during a reverse rotation of the rotatable shaft 540, interference between the knockdown device 900 and operation of the tamper 560 and paddles 531 may be avoided.

Figure 15:
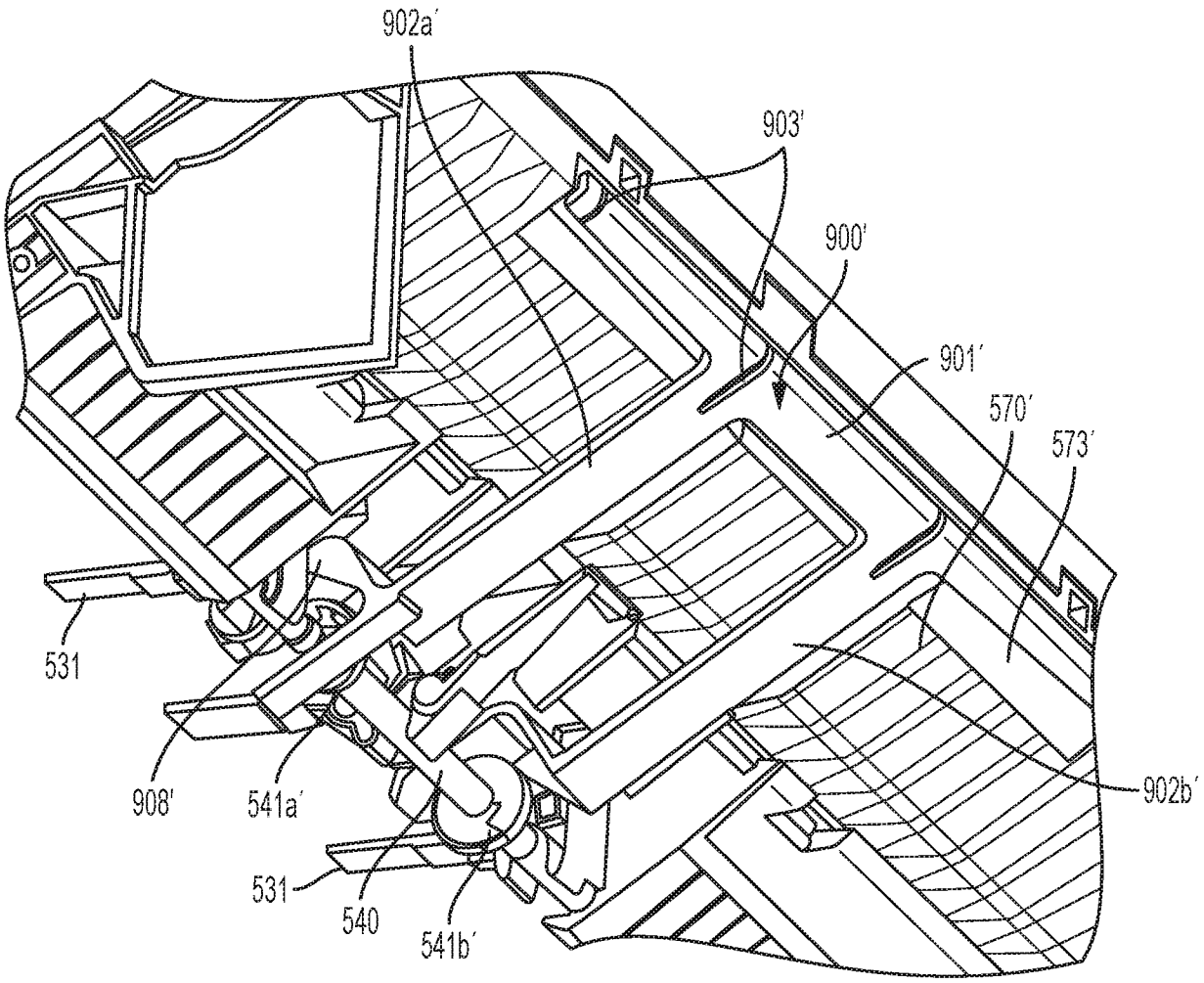
FIG. 15 is a perspective view of a knockdown device, according to an example.
Figure 16:
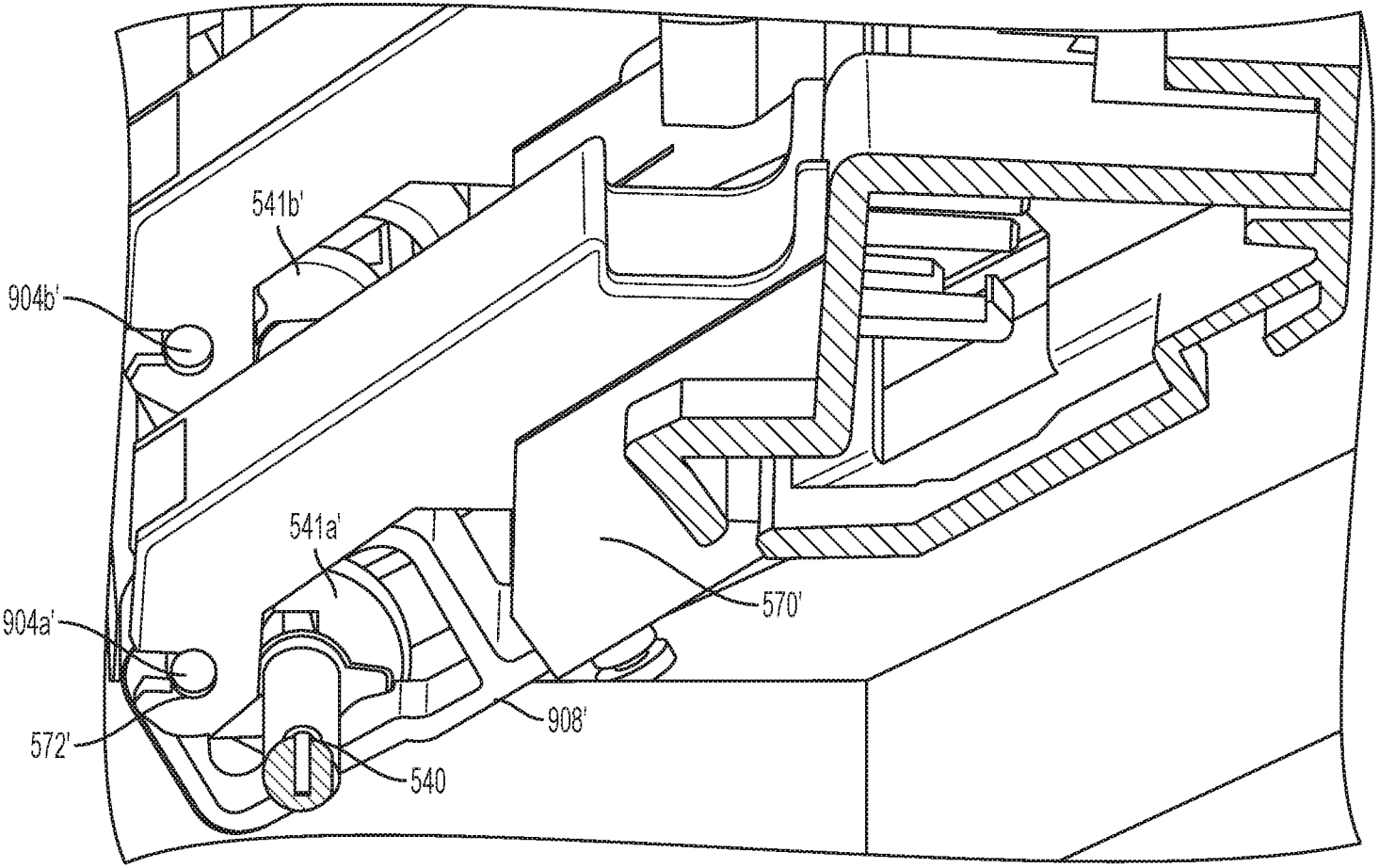
FIG. 16 is a side view of a knockdown device, according to an example.
Figure 17A:
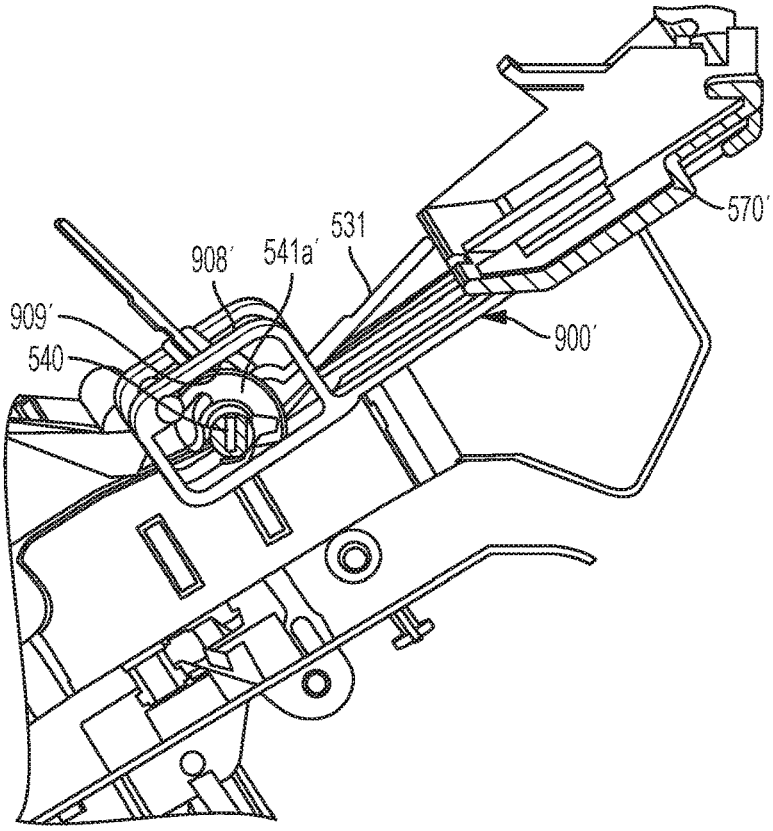
FIGS. 17A and 17B are side views of the knockdown device in an upper position and a lower position, respectively, according to an example.
Figure 17B:
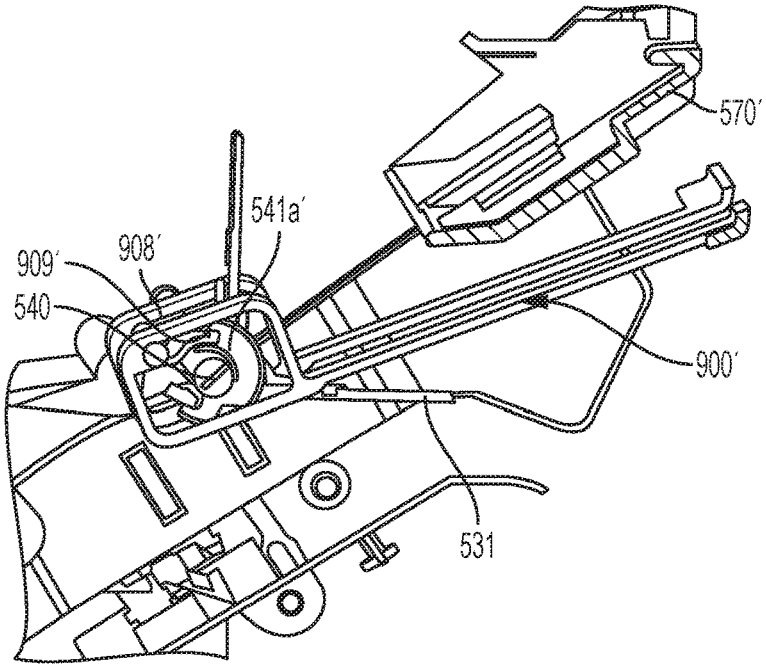

FIG. 15 is a perspective view of a knockdown device 900' in an upper position and coupled to the upper paper guide 570' of the compiler 500, according to an example. FIG. 16 is a side view of the knockdown device 900', according to an example. FIGS. 17A and 17B are side views of the knockdown device 900' in the upper position and a lower position, respectively, according to an example. The knockdown device 900' includes a body 901' that is elongated in a direction perpendicular to a rotation axis of the rotatable shaft 540. A length of the body 901' may be chosen in consideration of a range of widths of recording mediums that may be processed by the finisher 400 balanced with avoiding contacting with the tamper 560 during the compiling operation, for example. As shown in FIGS. 15 and 16, one end of each of the arms 902*a*', 902*b*' extends from the body 901' and the other end of each of the arms 902*a*', 902*b*' is coupled to the upper paper guide 570'.

The knockdown device 900' is mounted to the upper paper guide 570'. For example, each arm 902*a*', 902*b*' is coupled to the upper paper guide 570' by a rotatable knockdown shaft 904*a*', 904*b*' that is formed as a protrusion or pin which protrudes from an outer side of each of the arms 902*a*', 902*b*'. The rotatable knockdown shafts 904*a*', 904*b*' are inserted into a respective groove or pinhole 572' that is formed in a portion of the upper paper guide 570'. The knockdown device 900' is rotatable about the rotatable knockdown shafts 904*a*', 904*b*', such that a rotation axis of the knockdown device 900' is parallel to and offset from a rotation axis of the rotatable shaft 540. As can be seen from FIG. 16, the rotation axis of the knockdown device 900' is on an opposite side of the rotatable shaft compared to the rotation axis of the knockdown device 900 in FIG. 12.

The upper paper guide 570' may include a cutout or recess 573' formed therein to accommodate the arms 902*a*', 902*b*', and body 901' of the knockdown device 900' when the knockdown device 900' is in an upper position. The ability to store the knockdown device 900' in the recess 573' while the knockdown device 900' is not being utilized allows the knockdown device 900' to avoid contact with a recording medium being compiled as well as recording media stacked in the register tray 520. Also, a sound-dampening material may be provided in the recess 573' so that when the knockdown device 900' returns to the upper position, a noise may be reduced or minimized. A sound-dampening material can also be provided on an upper side of the knockdown device 900'.

A plurality of ribs 903' may be formed on a lower surface of the knockdown device 900'. The ribs 903' protrude from the lower surface of the knockdown device 900' such that when the knockdown device 900' contacts the recording medium a surface area of the knockdown device 900' that contacts the recording medium is less than a surface area of the knockdown device 900' that contacts the recording medium when no ribs are provided. Therefore, a noise level caused by the knockdown device 900' striking the recording medium can be reduced. The knockdown device 900' may be made of plastic, for example.

The knockdown device 900' may include surfaces which are chamfered, curbed, or angled in such a way to reduce a noise associated with rotating the knockdown in an upward and downward motion. For example, the body 901', arms 902*a*', 902*b*', ribs 903', or a combination thereof, may have curved surfaces.

As shown in FIGS. 15 through 17B, the end of the arms 902*a*', 902*b*' connected to the upper paper guide 570' may have various shapes. For example, the end of the arms 902*a*', 902*b*' connected to the upper paper guide 570' may have a closed rectangular or box shaped handle, an L-shaped handle, or a U-shape handle. In each of the examples of FIGS. 15 through 17B, cams 541*a*', 541*b*' are disposed at an inner side of the handles, such that an upper surface of the cams 541*a*', 541*b*' is in contact with an inner side surface of the corresponding handle.

FIGS. 17A and 17B are side views of the knockdown device 900' in the upper position and a lower position, respectively, according to an example. FIGS. 17A and 17B show cam 541*a*' in contact with inner side surface 909' of handle 908' provided at the end of arm 902*a*' of the knockdown device 900', according to an example. The knockdown device 900' can be rotated by rotation of the cams 541*a*', 541*b*' which are coupled to the rotatable shaft 540. As illustrated in FIG. 17A, when the cam 541*a*' is in an upper position, the knockdown device 900' is in an upper position. As illustrated in FIG. 17B, when the cam 541*a*' rotates to a lower position, due to a force applied by the cam 541*a*' to the inner side of the handle 908', the knockdown device 900' rotates downward to contact the recording medium. The cam 541*a*' completes its rotation to return to the highest position and the knockdown device 900' returns to the upper position.

An operation of the knockdown device 900' will now be described according to an example. When the recording medium is located on the register tray 520 the rotatable shaft 540 and paddles 531 may rotate in the forward direction. The rotatable shaft 540 and paddles 531 may rotate in the forward direction once or a plurality of times. The number of forward rotations may depend on a type of recording medium, an amount of ink on the recording medium, or a combination thereof, for example. For example, during the compiling of the recording medium, the controller 410 may transmit a signal to the driving source 430 to control the driving source 430 to rotate the rotatable shaft 540 in the forward direction a predetermined number of times.

The cams 541*a*', 541*b*' rotate together with rotation of the rotatable shaft 540. Therefore, the cams 541*a*', 541*b*' rotate a same number of times that the rotatable shaft 540 is rotated and a same number of times that the paddles rotate. Furthermore, because the knockdown device 900' is actuated when the cams 541*a*', 541*b*' rotate, the knockdown device 900' performs the knockdown of the recording medium a same number of times that the rotatable shaft 540 rotates. For example, if the paddles are rotated in the forward direction two times to compile a recording medium, the knockdown device 900' is actuated two times by the cams 541*a*', 541*b*' such that the knockdown device 900' is rotated and two knockdowns of the recording medium are performed. Likewise, if the paddles are rotated in the forward direction four times to compile a recording medium, four knockdowns of the recording medium are performed. For example, the knockdown device 900' may contact the leading edge or front portion of the recording medium.

As another example, the controller 410 may determine no forward rotation of the rotatable shaft 540 is to be performed. For example, the controller 410 may determine, based on a type of recording medium for example, that the recording medium is unlikely to have a curl and therefore paddling by the paddles 531 and a knockdown by the knockdown device 900' is not performed.

Actuation of the knockdown device 900' is based on the rotation of the rotatable shaft 540 to drive the motion of the knockdown device 900'. The cams 541*a*', 541*b*' are coupled to the rotatable shaft 540 so as to control the timing of the knockdown actuation. The knockdown device 900' can be activated such that rotation of the rotatable shaft 540 in the forward direction causes the knockdown device 900' to rotate downward to apply a force to the recording medium once per cycle or once each rotation of the rotatable shaft 540. According to this operation, actuation of the knockdown device 900' is dependent upon the number of forward paddles performed to compile media. For example, a number of times the knockdown device 900' is actuated and the number of forward paddles performed to compile media may be the same such that there is a 1 to 1 relationship between the number of times the knockdown device 900' is actuated and the number of forward paddles performed to compile media.

As another example, rotation of the knockdown device 900' in the forward direction may be based on the rotation of the rotatable knockdown shafts 904*a*', 904*b*', which may be combined as a single shaft, to drive the motion of the knockdown device 900'. That is, a driving source, other than a driving source used to drive rotatable shaft 540, may be provided to drive rotation of the rotatable knockdown shaft and the knockdown device 900'.

The knockdown device 900' is rotated to contact the recording medium and may be immediately rotated back upwards to the upper position to be stored in the recess 573' of the upper paper guide 570'. The knockdown device 900' may be lowered for a duration long enough to contact the recording medium and eliminate or reduce the curl in the recording medium, while also not delaying completion of the compiling and finishing operations unnecessarily. For example, for compiling of a recording medium during a single rotation of the rotatable shaft 540, the knockdown device 900' may be in contact with the recording medium for a duration less than a duration that the paddles 531 are in contact with the recording medium. Minimizing or reducing a duration that the knockdown device 900' is lowered also reduces a risk of the knockdown device 900' interfering with operation of the tamper 560 and paddles 531 during compiling.

Figure 18:
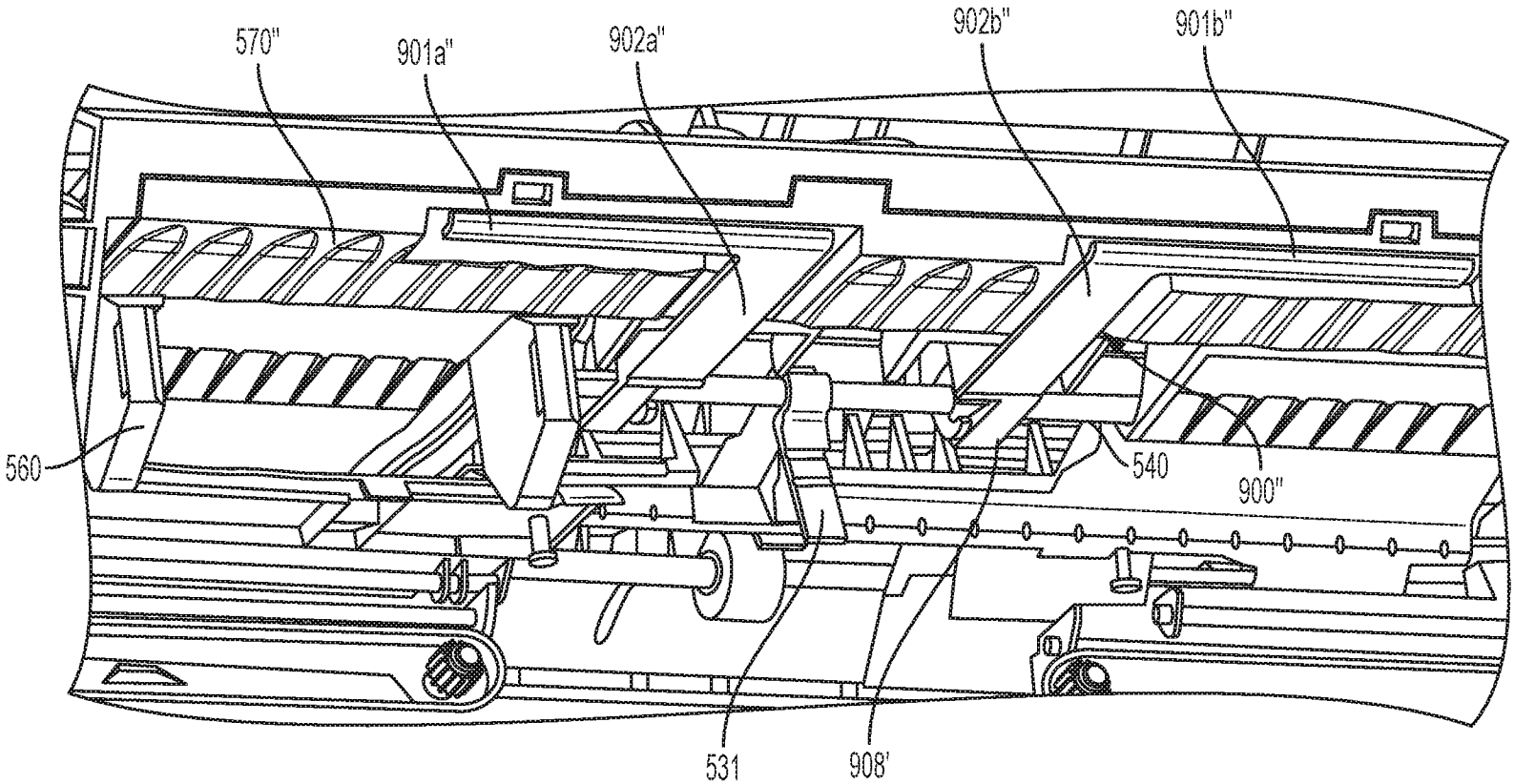
FIG. 18 is a perspective view of a knockdown device, according to an example.

FIG. 18 is a perspective view of a knockdown device 900" in an upper position and coupled to the upper paper guide 570" of the compiler 500, according to an example. The knockdown device 900" differs from the knockdown device 900' in that the two arms are not joined together by a common body, resulting in two L-shaped knockdowns. As shown in FIG. 18, the knockdown device 900" includes a first body 901*a*" and a second body 901*b*" that are each elongated in a direction perpendicular to a rotation axis of the rotatable shaft 540. A length of the first body 901*a*" and the second body 901*b*" and a distance that the first body 901*a*" and the second body 901*b*" are spaced apart from one another may be chosen in consideration of a range of widths of recording mediums that may be processed by the finisher 400 balanced with avoiding contacting with the tamper 560 during the compiling operation, for example. One end of first arm 902*a*" extends from the first body 901" and the other end of first arm 902*a*" is coupled to the upper paper guide 570". Likewise, one end of second arm 902*b*" extends from the second body 901" and the other end of second arm 902*b*" is coupled to the upper paper guide 570".

The knockdown device 900" may be mounted to the upper paper guide 570" in a manner similar to that described above with respect to knockdown device 900'. That is, except for the fact that arms 902*a*", 902*b*" are not joined together by a common body in contrast to the knockdown device 900', the knockdown device 900" may be considered to be similar in construction and operation in all other respects compared to knockdown device 900' and therefore a detailed description thereof will not be repeated. However, because arms 902*a*', 902*b*' of knockdown device 900' are joined together by the common body 903', the arms 902*a*', 902*b*' of knockdown device 900' may experience less torsion or twisting compared to the arms 902*a*", 902*b*" of knockdown device 900" during rotation.

After the knockdown device completes the knockdown action on the recording medium, and the recording media have been compiled in the register tray 520, a finishing process can be performed on the recording media and the finished recording media can be discharged or ejected from the compiler 500 to the lower output bin 456 for retrieval by a user. For example, the stapler 510 (see FIG. 3A) can perform a stapling operation on the recording media when the recording media has been compiled. The stapled recording media can be ejected or discharged from the compiler 500 to the lower output bin 456. For example, the stack of finished recording media can be ejected or discharged from the compiler 500 using a clamp that clamps an edge of the stack of finished recording media, ejector arms, a conveying belt 580 (see FIG. 5), and wheel 590 (see FIG. 5) that transport the stack of finished recording media out to the lower output bin 456.

As discussed above, various knockdown devices for a finisher may be implemented to knock down a recording medium during a compiling process of the recording medium so as to flatten the recording medium and eliminate or decrease a curl in the recording medium. Reduction of the curl can improve a job quality of compiled media stacks, enable increased temperatures to be utilized in the image forming apparatus to remove moisture from a recording medium, and increase a stack capacity of the compiler in the finisher.

Executable instructions to perform processes or operations in accordance with the above-described examples may be recorded in a machine readable storage. A controller may execute the executable instructions to perform the processes or operations. Examples of instructions include both machine code, such as that produced by a compiler, and files containing higher level code that may be executed by the controller using an interpreter. The instructions may be executed by a processor or a plurality of processors included in the controller. The machine readable storage may be distributed among computer systems connected through a network and computer-readable codes or instructions may be stored and executed in a decentralized manner.

The foregoing examples are merely examples and are not to be construed as limiting the disclosure. The disclosure can be readily applied to other types of apparatuses. Also, the description of the examples of the disclosure is intended to be illustrative, and not to limit the scope of the claims.

What is claimed is:

1. A knockdown apparatus for a finisher, comprising:
- a register tray;
- an upper paper guide provided above the register tray;
- a rotatable shaft coupled to the upper paper guide;
- a paddle coupled to the rotatable shaft to compile a recording medium toward an end of the register tray; and
- a knockdown device rotatably coupled to the upper paper guide to:
  - be provided above the register tray, and to rotate so that a rotation axis of the knockdown device is eccentric to a rotation axis of the rotatable shaft; and
  - apply a downward force to a first edge of the recording medium, the first edge being an edge of the recording medium nearest to an output bin while the recording medium is in the register tray, the output bin being opposite to the end of the register tray, to decrease a curl in the recording medium at the first edge of the recording medium,
  - wherein the knockdown device includes a tapered outer side to allow a tamper to contact and slide under the knockdown device as the tamper moves in an inward direction toward opposite sides of the recording medium to align the recording medium.

2. The knockdown apparatus of claim 1, wherein a first end of the knockdown device, opposite a second end of the knockdown device coupled to the upper paper guide, has a greater weight than the second end and the second end is to contact the first edge of the recording medium to apply the downward force to the recording medium while the recording medium is in the register tray.

3. The knockdown apparatus of claim 1, wherein the knockdown device includes:
- a first end coupled to the upper paper guide such that the knockdown device rotates about the first end, and
- a second end including at least one of a roller wheel or a rib, and
- the at least one of the roller wheel or the rib is to contact the recording medium to apply the downward force to the recording medium when the knockdown device rotates.

4. The knockdown apparatus of claim 1, wherein the knockdown device includes:
- a body elongated in an outward direction perpendicular to a rotation axis of the rotatable shaft,
- a first end of the body coupled to a portion of the upper paper guide such that the knockdown device rotates about the first end, and
- a second end of the body to, when the knockdown device rotates, contact the recording medium to apply the downward force to the recording medium.

5. The knockdown apparatus of claim 1, further comprising:
- a cam coupled to the rotatable shaft,
- wherein the knockdown device is coupled to another rotatable shaft coupled to the upper paper guide and includes:

a body, elongated in a direction parallel to the rotation axis of the rotatable shaft, to contact the recording medium and apply the downward force to the recording medium when the knockdown device rotates, and an arm having a first end coupled to the body and a second end to contact the cam such that when the cam rotates the knockdown device rotates.

6. The knockdown apparatus of claim 5, further comprising:

a clutch to prevent rotation of the cam in a first direction when the rotatable shaft rotates in the first direction and to permit rotation of the cam in a second direction when the rotatable shaft rotates in the second direction, wherein the paddle is to rotate in the first direction to compile the recording medium when the rotatable shaft rotates in the first direction.

7. The knockdown apparatus of claim 5, wherein:

the paddle is to rotate in a first direction to compile the recording medium together with rotation of the rotatable shaft in the first direction, the cam is to rotate in the first direction together with rotation of the rotatable shaft in the first direction, and rotation of the cam in the first direction causes the knockdown device to rotate in the first direction such that the body contacts the recording medium to apply the downward force to the recording medium.

8. The knockdown apparatus of claim 7, wherein a duration that the paddle contacts the recording medium to compile the recording medium toward the end of the register is greater than a duration that the body contacts the recording medium to apply the downward force to the recording medium.

9. The knockdown apparatus of claim 1, further comprising a pusher bar, separate from the knockdown device, to rotate and push downward against a second edge of the recording medium to assist the recording medium in dropping down to the register tray, the second edge of the recording medium being opposite the first edge.

10. The knockdown apparatus of claim 1, wherein the tamper coupled to the register tray aligns a stack of recording media in a widthwise direction of the recording media.

11. The knockdown apparatus of claim 10, wherein the tamper moves in the inward direction toward opposite sides of the recording media a plurality of times to align the stack of recording media in the widthwise direction.

12. The knockdown apparatus of claim 11, wherein as the tamper moves inward to align the stack of recording media, the tamper contacts the knockdown device, sliding under the knockdown device, and causing the knockdown device to rotate upward.

13. The knockdown apparatus of claim 1, wherein the upper paper guide includes a recess to accommodate the knockdown device while the knockdown device is not in use, wherein the recess includes a sound-dampening material to reduce noise of the knockdown returning to the recess.

14. A finisher, comprising:

a main body having an input port to receive a recording medium and an output port to output the recording medium after a finishing operation is performed on the recording medium; and a compiler section to receive the recording medium transported from the input port along a path within the finisher and to output the recording medium to the output port, the compiler section including:

a register tray to accommodate the recording medium for compiling, an upper paper guide provided above the register tray;

a rotatable shaft coupled to the upper paper guide;

a paddle coupled to the rotatable shaft to compile the recording medium toward an end of the register tray, and a knockdown device rotatably coupled to the upper paper guide to:

be provided above the register tray, and to rotate so that a rotation axis of the knockdown device is eccentric to a rotation axis of the rotatable shaft; and apply a downward force to a first edge of the recording medium, the first edge being an edge of the recording medium nearest to the output port while the recording medium is in the register tray, the output port being opposite to the end of the register tray, to decrease a curl in the recording medium at the first edge of the recording medium, wherein the knockdown device includes a tapered outer side to allow a tamper to contact and slide under the knockdown device as the tamper moves in an inward direction toward opposite sides of the recording medium to align the recording medium.

15. The finisher of claim 14, further comprising:

a driving source to drive rotation of the rotatable shaft;

a controller to control the driving source to rotate the rotatable shaft in at least one of a forward direction to rotate the paddle in the forward direction to compile the recording medium or a reverse direction; and a cam, coupled to the rotatable shaft, to contact an end of the knockdown device such that rotation of the cam causes the knockdown device to be rotated, the cam being rotatable in at least one of the forward direction or the reverse direction.

16. The finisher of claim 14, wherein the knockdown device includes:

a first end coupled to the upper paper guide such that the knockdown device rotates about the first end, and a second end including at least one of a roller wheel or a rib, and the at least one of the roller wheel or the rib is to contact the recording medium to apply the downward force to the recording medium when the knockdown device rotates.

17. The finisher of claim 14, wherein:

the compiler section further includes a cam coupled to the rotatable shaft, and the knockdown device is coupled to another rotatable shaft coupled to the upper paper guide and includes:

a body, elongated in a direction parallel to the rotation axis of the rotatable shaft, to contact the recording medium and apply the downward force to the recording medium when the knockdown device rotates, and an arm having a first end coupled to the body and a second end to contact the cam such that when the cam rotates the knockdown device rotates.

18. A non-transitory machine readable storage comprising instructions that when executed cause at least one processor of a finisher to:

control a driving source of the finisher to rotate a first rotatable shaft in a compiling section of the finisher in a forward direction such that a paddle coupled to the first rotatable shaft rotates in the forward direction to compile a recording medium in a register tray of the finisher; and control the driving source to rotate the first rotatable shaft in one of the forward direction or a reverse direction to cause a knockdown device coupled to a second rotatable shaft and provided above the register tray to rotate to apply a downward force to a first edge of the recording medium while the recording medium is in the register tray, the first edge being an edge of the recording medium nearest to an output of the finisher, the output being opposite to an end of the register tray in which the recording medium is compiled, to decrease a curl in the recording medium at the first edge of the recording medium, wherein the knockdown device includes a tapered outer side to allow a tamper to contact and slide under the knockdown device as the tamper moves in an inward direction toward opposite sides of the recording medium to align the recording medium.

19. The non-transitory machine readable storage of claim 18, wherein the non-transitory machine readable storage further comprises instructions that when executed cause the at least one processor to:

control the driving source to rotate the first rotatable shaft in the reverse direction after the paddle is rotated in the forward direction, to rotate a cam, coupled to the first rotatable shaft, in the reverse direction thereby causing the knockdown device to rotate about the second rotatable shaft in the forward direction to apply the downward force to the recording medium.

* * * * *